US008814469B2

(12) United States Patent
McCormick et al.

(10) Patent No.: US 8,814,469 B2
(45) Date of Patent: Aug. 26, 2014

(54) ARTICULATED BED-MOUNTED FINNED-SPAR-BUOY DESIGNED FOR CURRENT ENERGY ABSORPTION AND DISSIPATION

(71) Applicant: Murtech, Inc., Glen Burnie, MD (US)

(72) Inventors: Michael E. McCormick, Annapolis, MD (US); Robert Murtha, Stevensville, MD (US)

(73) Assignee: Murtech, Inc., Glen Burnie, MD (US)

( * ) Notice: Subject to any disclaimer, the term of this patent is extended or adjusted under 35 U.S.C. 154(b) by 0 days.

(21) Appl. No.: 13/709,264

(22) Filed: Dec. 10, 2012

(65) Prior Publication Data

US 2014/0161532 A1 Jun. 12, 2014

(51) Int. Cl.
*E02B 3/06* (2006.01)
*E02B 3/02* (2006.01)

(52) U.S. Cl.
CPC ..... *E02B 3/02* (2013.01)
USPC ..... 405/28; 405/21

(58) Field of Classification Search
USPC ..... 405/15, 21, 23, 24, 25, 26, 28, 34, 35
See application file for complete search history.

(56) References Cited

U.S. PATENT DOCUMENTS

| | | | | | |
|---|---|---|---|---|---|
| 260,016 | A | * | 6/1882 | Franklin | 405/26 |
| 1,636,447 | A | | 7/1927 | Standish | |
| 2,731,799 | A | * | 1/1956 | Lange et al. | 405/35 |
| 3,022,632 | A | * | 2/1962 | Parks | 405/26 |
| 3,191,202 | A | * | 6/1965 | Handler | 441/22 |
| 3,376,588 | A | | 4/1968 | Berteaux et al. | |
| 3,628,334 | A | * | 12/1971 | Coleman | 405/26 |
| 3,755,836 | A | | 9/1973 | Milazzo | |
| 3,846,990 | A | | 11/1974 | Bowley | |
| 3,848,419 | A | | 11/1974 | Bowley | |
| 4,004,308 | A | * | 1/1977 | Gongwer | 441/22 |

(Continued)

FOREIGN PATENT DOCUMENTS

| | | |
|---|---|---|
| CA | 1193490 | 9/1985 |
| DE | 2248260 | 4/1974 |

OTHER PUBLICATIONS

Budar, et al., "A Resonant Point Absorber of Ocean-Wave Power," Nature, vol. 256, pp. 478-480 (1975).

(Continued)

*Primary Examiner* — Frederick L Lagman
(74) *Attorney, Agent, or Firm* — Caesar, Rivise, Bernstein, Cohen & Pokotilow, Ltd.

(57) ABSTRACT

A constrained buoy experiencing vortex-induced, in-line and transverse angular motions and designed to absorb and attenuate the energies of streams, rivers and localized ocean currents is described. Referred to as a Finned-Spar-Buoy (FSB), the buoy design can be considered an exoskeleton, in that vertical fins are externally mounted on a vertical cylindrical float. The fins increase the drag coefficient by enhancing the wake losses. The FSB operates as a single unit or as a component of an array, depending on the application. The FSB can adjust to high-water events caused by tides, storm surges or spring-melting runoffs because the FSB can move axially along a center-staff which is attached to an anchor pole at a pivot point. The buoy-staff system is allowed to rotate in any angular direction from the vertical, still-water orientation of the center-staff. The FSB has a relatively small diameter-to-draft ratio, analytically qualifying the buoy as a slender-body.

19 Claims, 15 Drawing Sheets

(56) References Cited

U.S. PATENT DOCUMENTS

| | | | | |
|---|---|---|---|---|
| 4,048,802 | A | 9/1977 | Bowley | |
| 4,255,066 | A * | 3/1981 | Mehlum | 405/76 |
| 4,264,233 | A * | 4/1981 | McCambridge | 405/26 |
| 4,280,238 | A | 7/1981 | van Heijst | |
| 4,894,873 | A | 1/1990 | Kiefer et al. | |
| 4,954,110 | A * | 9/1990 | Warnan | 441/22 |
| 5,558,459 | A | 9/1996 | Odenbach et al. | |
| 5,879,105 | A * | 3/1999 | Bishop et al. | 405/26 |
| 6,406,221 | B1 * | 6/2002 | Collier | 405/213 |
| 7,264,420 | B2 * | 9/2007 | Chang | 405/195.1 |
| 7,900,571 | B2 * | 3/2011 | Jaber et al. | 441/23 |
| 8,647,014 | B2 | 2/2014 | McCormick et al. | |
| 2006/0112871 | A1 * | 6/2006 | Dyhrberg | 114/293 |
| 2011/0299927 | A1 | 12/2011 | McCormick | |
| 2013/0008158 | A1 * | 1/2013 | Hon | 60/506 |

OTHER PUBLICATIONS

Falnes, "Ocean Waves Oscillating Systems," published by Cambridge University Press, 2002, pp. 196-224.

Garnaud, et al, "Comparison of Wave Power Extraction by a Compact Array of Small Buoys and by a Large Buoy", Proceedings of the 8th European Wave and Tidal Energy Conference, Uppsala, Sweden, 2009, pp. 934-942.

Lee, et al., "On the Floating Breakwater—A New Arrangement," Proceedings, International Conf. on Coastal Engineering, Taipei (1986), pp. 2017-2022.

Liang, et al., "A Study of Spar Buoy Floating Breakwater," Ocean Engineering, 31(2004) pp. 43-60.

McCormick, "Ocean Wave Energy Conversion," published by Wiley-Interscience, New York (1981, reprinted by Dover Publication, Long Island, New York in 2007), pp. 117-136.

Murali, et al., "Performance of Cage Floating Breakwater", Journal of Waterway, Port, Costal and Ocean Engineering (ASCE), pp. 172-179 (1997).

International Search Report for related PCT Application No. PCT/US2011/038709, dated Aug. 12, 2011.

Bernitsas, et al., "VIVACE (Vortex Induced Vibration for Aquatic Clean Energy): A New Concept in Generation of Clean and Renewable Energy from Fluid Flow," Proceedings of OMAE2006, Paper OMAE06-92645, Hamburg, Germany Jun. 4-9, 2006, pp. 1-18.

Blevins, Robert D., "Flow-Induced Vibrations," Van Nostrand Reinhold, New York, 1990, pp. 194-213.

Cébron, et al., "Vortex-Induced Vibrations Using Wake Oscillator Model Comparison on 2D Response with Experiments," Institute of Thermomechanics, Prague, 2008.

Farshidianfar, et al., "The Lock-in Phenomenon in VIV Using a Modified Wake Oscillator Model for Both High and Low Mass-Damping Ratio," Iranian Journal of Mechanical Engineering, vol. 10, No. 2, Sep. 2009.

Jauvitis, et al., The Effect of Two Degrees of Freedom on Vortex-Induced Vibration at Low Mass and Damping,: J. Fluid Mechanics, vol. 509, 2004, pp. 23-62.

Leong, et al., "Two-Degree-of-Freedom Vortex-Induced Vibration of a Pivoted Cylinder Below Critical Mass Ratio," Proceedings of the Royal Society A, vol. 464, 2008, pp. 2907-2927.

McCormick, et al., "Full-Scale Experimental Study of Bi-Modal Buoy," Report EW 01-11, Department of Naval Architecture and Ocean Engineering, U.S. Naval Academy, Jun. 2011, 32 pages.

McCormick, et al., "Planing Characteristics of Fast-Water Buoys," Journal of the Waterways Harbors and Coastal and Engineering Division, vol. 99, No. WW4, Nov. 1973, pp. 485-493.

McCormick, et al., "Prototype Study of a Passive Wave-Energy Attenuating Bi-Modal Buoy," Murtech, Inc. Report M-12-1, Jan. 2012, 26 pages.

Miles, John W., "On the Interference Factors for Finned Bodies," J. Aeronautical Sciences, vol. 19, No. 4, Apr. 1952, p. 287.

Ng, et al., "An Examination of Wake Oscillator Models for Vortex-Induced Vibrations," Naval Undersea Warfare Center Division, Newport, RI, Technical Report 11,298, Aug. 1, 2011, 18 pages.

Ogink, et al., "A Wake Oscillator With Frequency Dependent Coupling for the Modeling of Vortex-Induced Vibration," Journal of Sound and Vibration, No. 329, 2010, pp. 5452-5473.

Rodenbusch, George, "Response of a Pendulum Spar to 2-Dimensional Random Waves and a Uniform Current," Massachusetts Institute of Technology and Woods Hole Oceanographic Institution, Engineering Program, Ph.D. Dissertation, Aug. 1978, 138 pages.

Ryan, et. al., "Energy Transfer in a Vortex Induced Vibrating Tethered Cylinder System", Conf. on Bluff Body Wakes and Vortex-Induced Vibrations, Port Douglas, Australia, Dec. 2002, 4 pages.

Shiguemoto, et al., "Vortex Induced Motions of Subsurface Buoy with a Vertical Riser: A Comparison Between Two Phenomenological Models" Proceedings, 23° Congresso Nacional de Transporte Aquaviário, Construção Naval e Offshore, Rio de Janeiro, Oct. 25-29, 2010, pp. 1-9.

Sobey, et al., "Hydrodynamic of Circular Piles," Proceedings, 6th Australian Hydraulics and Fluid Mechanics Conference, Adelaide, Dec. 1977, pp. 253-256.

* cited by examiner

ARTICULATED BED-MOUNTED FINNED-SPAR-BUOY DESIGNED FOR CURRENT ENERGY ABSORPTION AND DISSIPATION

STATEMENT REGARDING FEDERALLY SPONSORED RESEARCH OR DEVELOPMENT

"Not Applicable"

FIELD OF THE INVENTION

This invention relates generally to floating systems including at least one buoy arranged to absorb and attenuate the energies of streams, rivers and localized ocean currents, and thus stabilize underwater sand bars.

BACKGROUND OF THE INVENTION

For many years, strong river and tidal currents have posed problems in navigation, ship handling and shoreline erosion. The navigation problem in rivers stems from the fact that the currents cause bed erosion up-river and accretion down-river. The current, then, causes the accreted beds to meander. This is particularly true on the Mississippi River system, where bars appear at bends and, then, disappear. The U. S. Coast Guard has been responsible for marking these meandering bars. In order to warn mariners of the presence of sand bars, fast-water buoys have been deployed by the Coast Guard. These fast-water buoys have two major problems. The first is that the buoy motions become unstable at certain current speeds, as described by McCormick and Folsom (1973) and others. The second problem is that the buoys are subject to mooring failures caused by fatigue or collisions with passing vessels. These problems could be alleviated by more permanence in the bar locations.

Many vortex-induced-motions (VIM), vortex-induced vibration (VIV) and wake-force studies have been performed since the middle of the last century. Normally, VIM studies involve moored bluff bodies; while, VIV studies are devoted to cables. The characterization of these studies and sample studies are as follows:

(a) Vortex-induced forces on fixed, rigid bodies, as by Sobey and Mitchell (1977).

(b) 2-Dimensional vortex-induced transverse motions, as by Bernitsas et al (2006), Farshidianfar and Zanganeh (2009), Leong and Wei (2008), Ng et al (2001) and Ogink, and Metrikine (2010).

(c) 2-Dimensional vortex-induced (un-coupled or coupled) in-line and transverse motions, as by Cebron et al (2008), Jauvitis, and Williamson (2004), Ryan (2002) and Shiguemoto et al (2010).

(d) 3-Dimensional vortex-induced motions, as by Rodenbusch, G. (1978).

These can further be sub-classified as current-induced and wave-induced. The analyses can be linear-harmonic or non-linear wake-oscillator. The latter involves the use of the van der Pol equation to represent the lift force produced by the wake hydrodynamics. An excellent compilation and discussion of all of the pre-1990's results can be found in the book by Blevins (1990).

The analysis is partially empirical in nature due to the coefficients based on the experimental reports of McCormick and Steinmetz (2011) and McCormick and Murtha (2012). The experiments referred to were conducted using a bi-modal buoy equipped with vertical fins and a horizontal damping plate. That buoy system is designed to absorb and dissipate wave energy. The experiments were conducted in a 117-meter wave and towing tank. The analysis of the interaction of the fin-spar buoy (FSB) and a current is guided by the analysis of Rodenbusch (1978), and the performance as an energy dissipater follows the energy analysis that leads to a hydraulic jump.

U.S. Patent Publication No. 2011/0299927 (McCormick, et al.), which is owned by the same Assignee, namely, Murtech, Inc. of Glen Burnie, Md., as the present application, is directed to a buoy for use in reducing the amplitude of waves in water and a system making use of plural buoys to create a floating breakwater.

However, there presently exists a need for a buoy that absorbs and attenuates the energies of streams and rivers which overcomes the disadvantages of the prior art. The subject invention addresses that need.

SUMMARY OF THE INVENTION

A method for reducing the energy in a stream or river current is disclosed. The method comprises: locating a plurality of buoys upstream of an object that is at least partially submerged and exposed to the stream or river current (e.g., a piling, a sand bar, etc.); anchoring the plurality of buoys to a bed in the stream or river; and permitting the plurality of buoys to pivot about the anchor due to exposure of the plurality of buoys within the stream or river that causes buoy movement and vortex shedding, thereby dissipating energy of the stream or river current.

A buoy array for reducing the energy in a stream or river current is disclosed. The buoy array comprises: a plurality of buoys that are disposed at a predetermined distance from one another upstream of an object that is at least partially submerged and exposed to the stream or river current (e.g., a piling, a sand bar, etc.), and wherein the plurality of buoys is positioned transversely of the stream or river current, and wherein each one of the plurality of buoys comprises: an elongated cylindrical body with a plurality of vertically-oriented fins protruding radially away from an outer surface of the body; and wherein each of the bodies comprises a center staff that is coupled to a hinge and each of the hinges is coupled to the stream or river bed, wherein the hinge permits the body to freely rotate about the hinge when each of the bodies are exposed within the stream or river that causes buoy movement and vortex shedding, thereby absorbing and dissipating energy of the stream or river current.

The materials used for the construction of the buoy may be metal, plastic, composites, natural or any combination thereof. The color of the buoys may vary.

DETAILED DESCRIPTION OF THE PREFERRED EMBODIMENT

Figure 1:
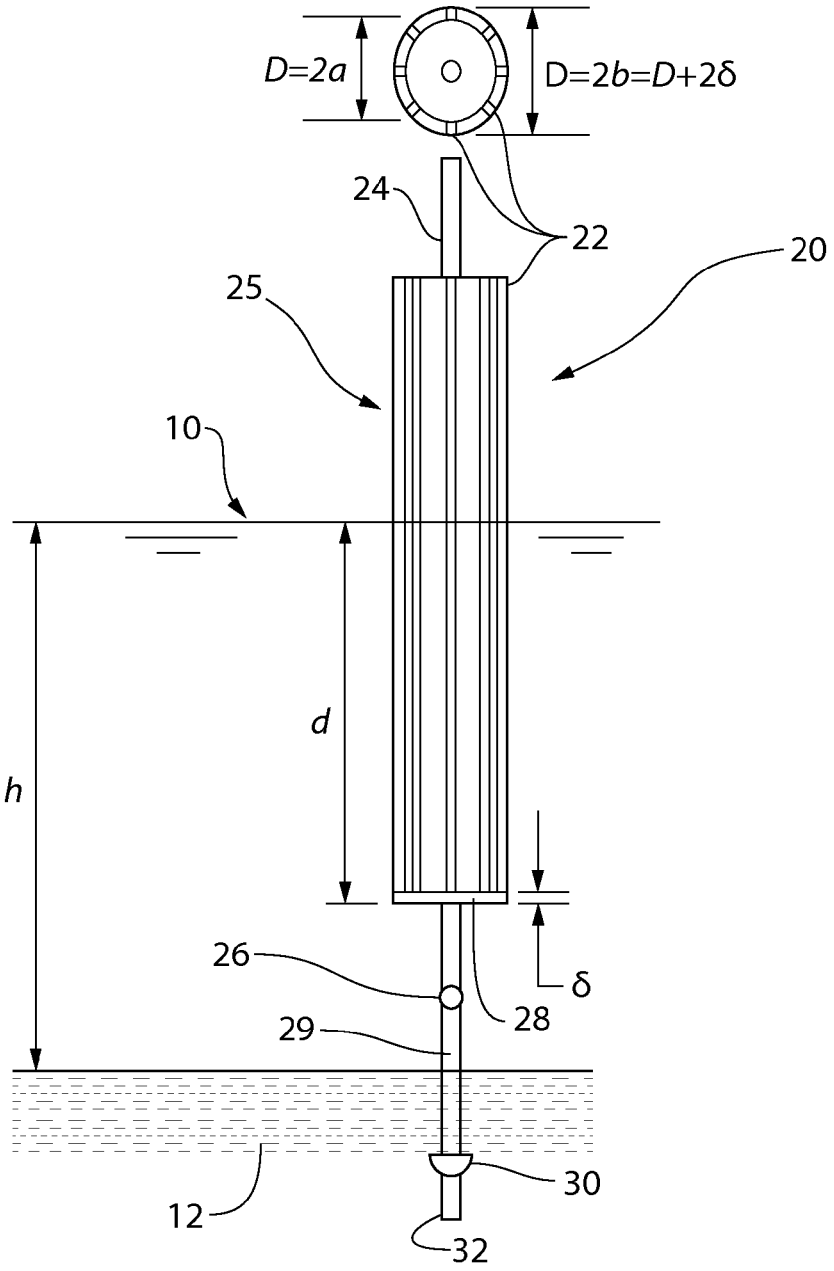
FIG. 1 is a side view of the finned-spar buoy (FSB) of the present invention shown installed in a stream or river in a still-water orientation.

Referring now to the various figures of the drawing wherein like reference characters refer to like parts, there is shown in FIG. 1 one exemplary device 20 constructed in accordance with this invention. The buoy system of interest herein is called the Finned-Spar-Buoy (FSB) 20. Referring to the sketch in FIG. 1, the FSB 20 comprises a central circular cylindrical float body 25 supported by a center-staff 24. When the FSB 20 is positioned in a stream or river 10, the center-staff 24 is designed to freely rotate about a bed-mounted spring-loaded hinge assembly 26 which, in turn, is supported by an anchor-staff formed by a reaction plate 30 and an embedded anchor 32 both of which are buried within the stream or river bed 12. An axial resistance plate 28 forms the lower portion or base of the central circular cylindrical float body 25. The exoskeleton design in FIG. 1 comprises a number of vertical fins 22 mounted on the central circular cylindrical float body 25. The fins 22 are designed to transform much of the energy of an incident current into wake energy in the form of vortices. Depending on the Reynolds number (the non-dimensional current speed), the character of the wake can be laminar or turbulent, and the wake vortices can be either fixed or shed. Because the FSB 20 is free to rotate in any direction, the shed vortices in the wake cause both in-line and transverse motions of the FSB 20. These vortex-induced-motions (VIM) enhance the ability of the FSB 20 to alter the energy of the current.

As shown in FIG. 1, the eight (by way of example only) rigid vertical fins 22 are oriented radially-outward. The fins 22 are designed to enhance the in-line and transverse drag on the FSB 20. It should be noted that spiral fins have been used to reduce the vortex-induced motions of risers and tethers in the offshore industry. The spiral fin is thought to reduce the correlation length along the both. This is not the case with vertical fins, as is the case here. A lower number of fins 22 (four or less) reduces the omni-directionality of the body 25; while, a larger number (ten or more) behaves as an extremely rough cylinder in a flow. As mentioned previously, at the base of the FSB 20 is a horizontal circular plate 28. This plate 28 is designed to retard the axial motions of the FSB 20 and to limit end effects, but not to eliminate the axial motion. The FSB 20 is designed to adjust to changes in the mean water level caused by spring floods, tidal changes, etc.

It should be noted that the anchoring system for the FSB 20 can be an embodiment anchor, a clump anchor, etc.

Figure 2:
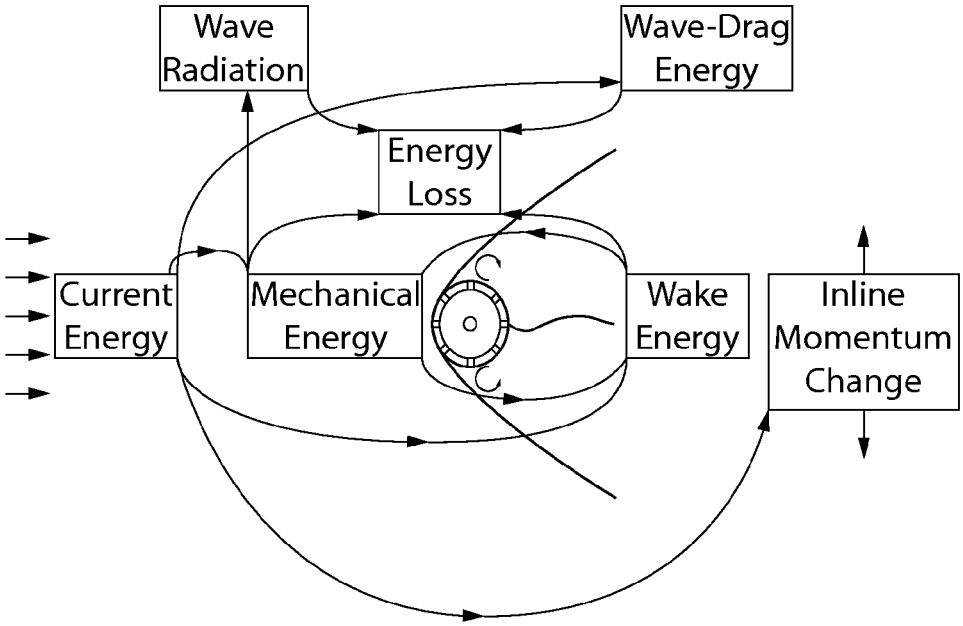
FIG. 2 is a diagram showing the energy paths for the FSB in a steady, uniform current.

The energy path for the FSB 20 is sketched in FIG. 2. In that figure, a horizontal "strip" of the submerged portion of the FSB 20 is sketched, with its dominant motions shown. The total energy in the system must equal that of the current 10. Part of this energy is transferred to the FSB 20 directly, causing it to move in the inline direction. Almost simultaneously, a wake is created downstream from the FSB 20, in which vortices are shed. The effect of the vortex-shedding is sketched in FIG. 3, along with the displacements of the strip from the still-water position. Returning to the sketch in FIG. 3, there is a feedback effect between the FSB 20 and its wake, where the mechanical energy is transferred to the wake and the hydrodynamic wake energy is transferred back to the FSB 20. This feedback performance causes the FSB 20 motions to increase until reaching a steady-state condition which depends on the upstream current speed, U. In addition to the energy transfer, the vorticular motions in the wake have components that are transverse. This causes a transverse component of the fluid momentum, which is considered a "loss" in fluid dynamics. The bounds of the wake are the separation streamlines which spread out a number of diameters from the centerline of the FSB 20 in FIG. 2. This causes the current that is not directly interacting with the body 25 to be affected by the vortex-shedding from the body and the vortex-induced motions of the body 25. Energy is lost by both the body motions and the vortex motions due to a combination of surface waves from the former and viscous effects of both the former and latter.

Figure 3:
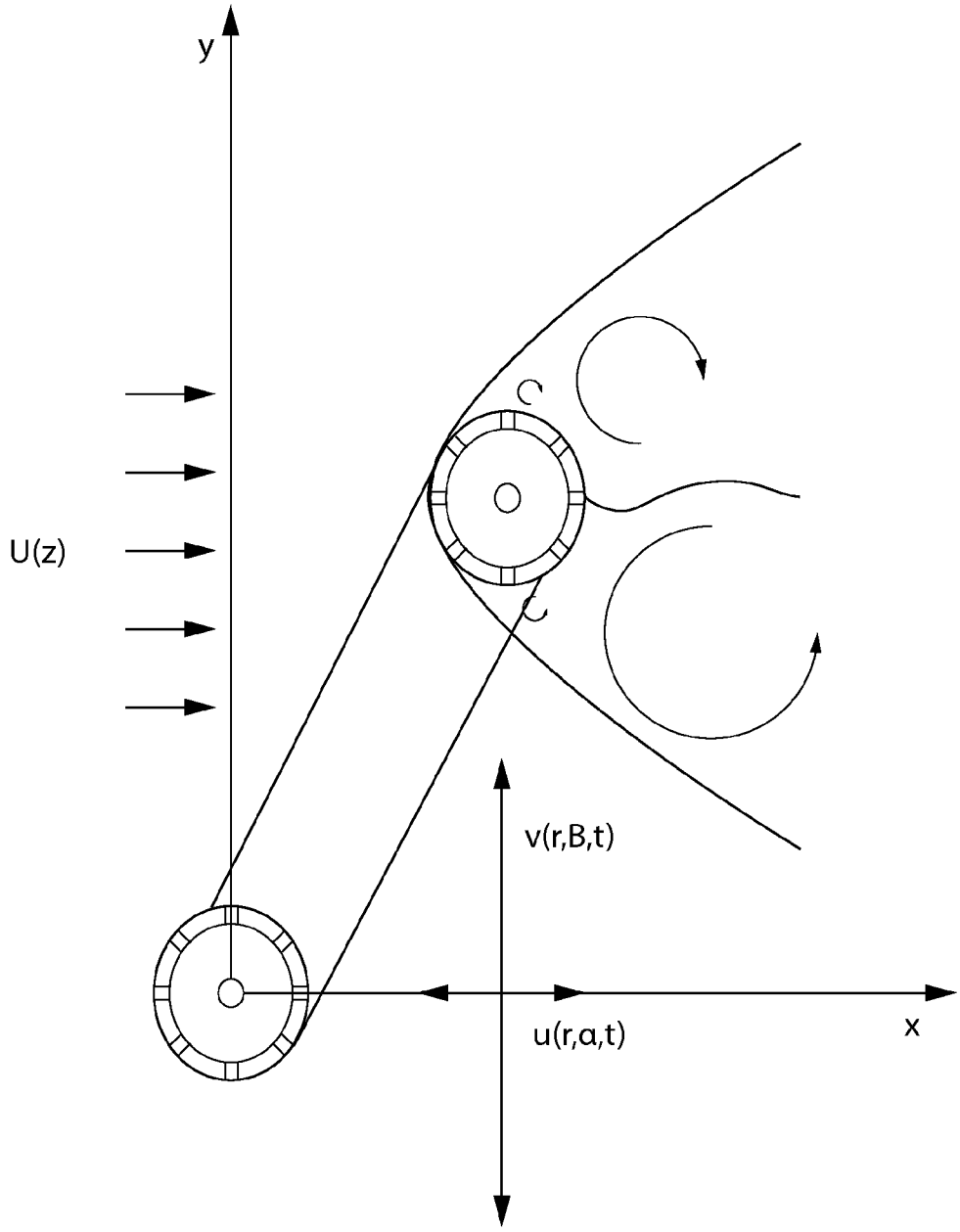
FIG. 3 is a diagram showing the vortex shedding and induced motions of a strip portion of the FSB.

The assumed vortex-shedding pattern is shown in FIG. 3 from a strip of the body 25 at a given depth z (<h), where h is the upstream water depth. Because of the energy extraction by the FSB 20 and the energy dissipation in the wake, the downstream water depth will rise. That is, the energy absorption and dissipation will cause a depth change, where the water depth increases and the kinetic energy of the current decreases. This decrease will result in transported suspended sand dropping out of the flow, resulting in a bar formation. Here, then, the FSB 20 acts to stabilize the bed 12 by causing accretion. Thus, where sand beds tend to drift from one side of the stream/river 10 to the other side due to stream/river current energies throughout the year, with the FSB 20 in place to reduce the stream/river current energy, the sand beds tend to remain stable and do not drift. It should be noted that the vortices in the wake are assumed to be shed alternately, and the current velocity is steady but not uniform over the draft of the FSB 20.

Figure 4:
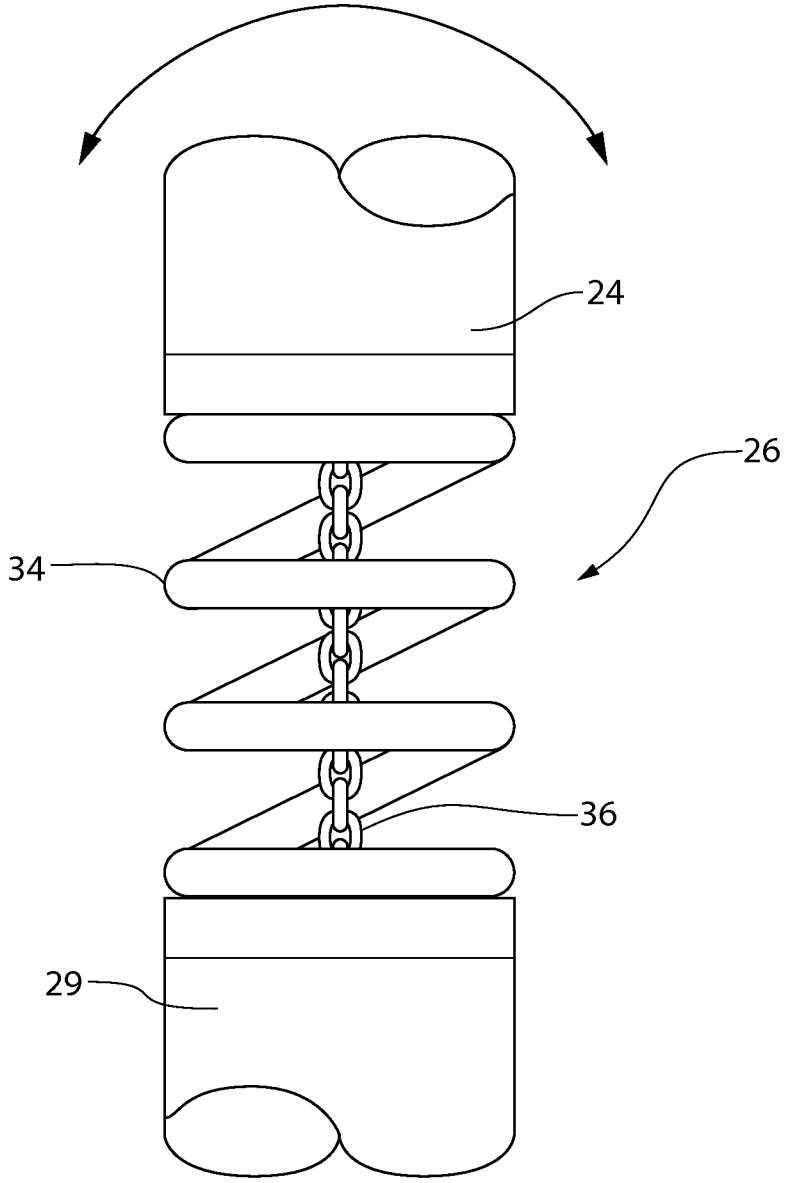
FIG. 4 is a partial diagram of an exemplary spring-loaded hinge of the FSB.

As mentioned previously, the center-staff 24, which guides the axial motions, is connected to an anchor by a spring-loaded hinge 26, as in FIG. 1. An example of a spring-loaded hinge 26 is sketched in FIG. 4. That system in that sketch was used by Rodenbusch (1978) in an experimental study on a smooth-skin spar buoy in waves and currents. A spring 34 can be pre-loaded by incorporating a turnbuckle between the upper plate 28 that supports the spring 34 and the center-staff 24. This would be done to limit the excursions of the FSB 20. In the analysis of the system, then, there are three restoring moments. The first results from the displacement of the FSB 20, which is constant since the FSB 20 is able to adjust its axial position. The second moment is due to the buoyancy resulting from the time-dependent angular displacements resulting from the vortex-induced shedding. The last restoring moment results from the angular displacement of the spring 34.

Lastly, there is a steady-state wave-drag which is significant at high current speeds.

Figure 5:
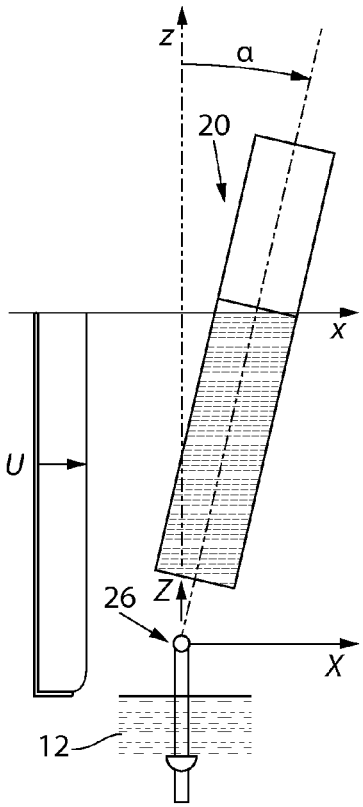
FIG. 5 is a diagram of one of the primary rotational planes of the FSB and in particular shows the in-line orientation.

As mentioned previously, the FSB 20 rotates about a spring-hinge 26. The primary rotational planes are shown in FIG. 5 ("in-line" orientation) and FIG. 6 ("transverse" orientation). The axial resistance bottom-plate 28 (of thickness Δ) is used to minimize the higher frequency axial motions. The FSB 20, however, is free to respond to low-frequency changes due to tides and storm surges. The system in a current, U, will have a steady component in the x-z plane, where the angle $\alpha_0$ is determined by the ratio of the average buoyant force and the hydrodynamic force. The FSB 20 cross-section has a circular cylinder of radius a, and a fin radius of b. The fin width (from body 25 to the outer fin-edge) is δ.

Analysis of FSB Motion in the Current

The goal of this section is to establish the equations of motions for the FSB 20 in FIG. 1.

Before doing this, an expression for the averaged angular deflection in the x-z plane must be obtained. This angle is a function of the mean buoyant moment, the mean spring moment and the hydrodynamic moment. The time-dependent analysis follows, where the equations of motion in terms of α and β are derived. See FIGS. 5 and 6, respectively, for sketches of these variables.

The dynamic analysis somewhat follows that of Rodenbusch (1978), in that the analysis is quasilinear in nature. In addition, the moments resulting from the lift and drag forces are such that the frequency of the lift force is twice that of the drag force, where the frequency itself is that of the vortex shedding.

A. Quasi-Static Angular Displacement in a Steady Current

Figure 7A:
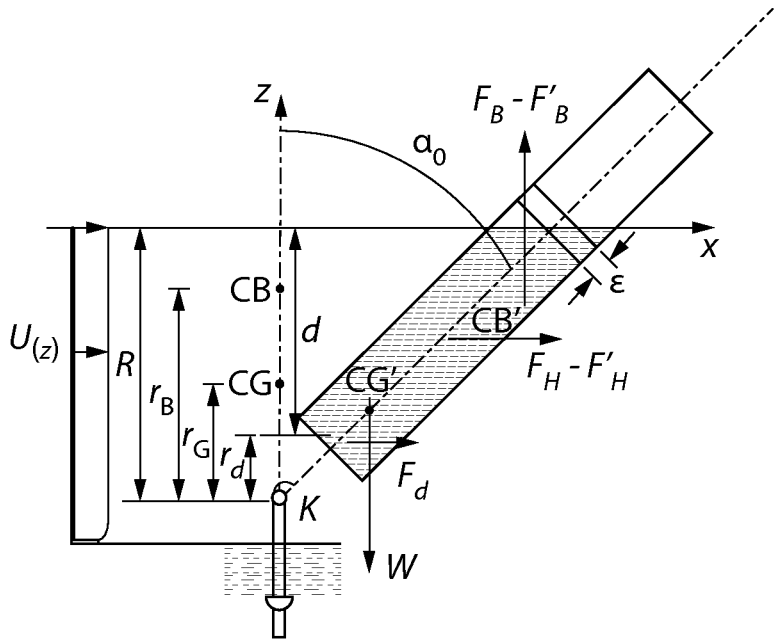
FIG. 7A is a force notation of the FSB in the stream or river current flow.
Figure 7B:
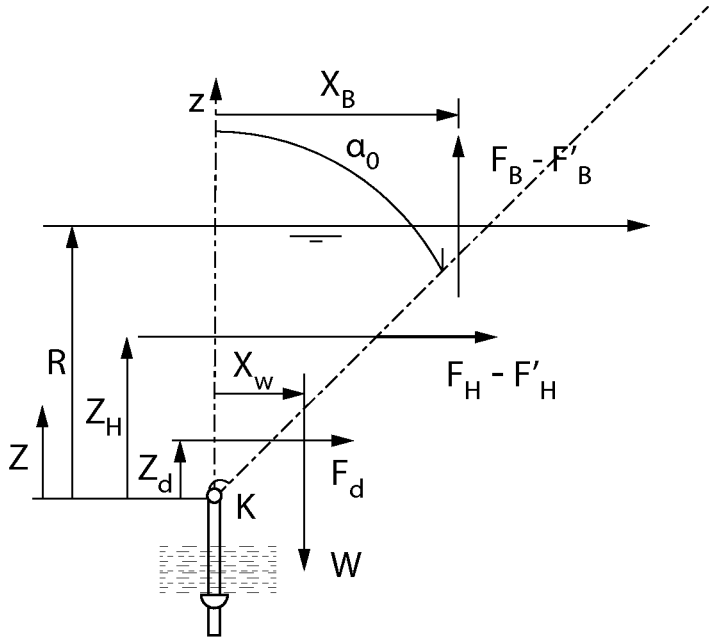
FIG. 7B is a force diagram of the FSB in the stream or river current flow.

Consider the forces shown in FIGS. 7A-7B. Because the FSB 20 is allowed to travel freely in the axial direction in FIGS. 7A-7B, the balance of the axial forces yields the following angle:

$$(F_B-F_B'-W)\cos(\alpha_0)+(F_H-F_H'+F_d)\sin(\alpha_0)=-F_B'\cos(\alpha_0)+(F_H-F_H'+F_d)\sin(\alpha_0)\simeq-F_B'+(F_H-F_H'+F_d)\alpha_0=0 \quad (1)$$

The unknown axial displacement, ϵ, in FIG. 5a but not in eq. (1), is due to balance of the axial forces $F_B'$, $F_H'$ and $F_d$. These forces, in turn, depend on $\alpha_0$. The second line is due to the equality of the still-water buoyancy and weight. In the analysis which follows, the angle $\alpha_0$ is assumed to be small so that $\cos(\alpha_0)\approx1$ and $\sin(\alpha_0)\approx\alpha_0$. These approximations are valid for values of $\alpha_0$ up to 15°. This angle is used later to determine the design spring constant, K in FIGS. 7A-7B. Because of the small-angle assumption, the portion of ϵ due to the angular displacement is negligible; however, that part due to the dynamic pressure on the bottom and the axial viscous shear force on the sides is not. Thus, the portion due to a static (still water) angular change is neglected.

The forces in the second line are as follows:

$$F_B'-\rho g\pi a^2\epsilon \quad (2)$$

$$F_H-F_H=\tfrac{1}{2}\rho(2a)C_D[R-(r_d+e)\cos(\alpha_0)]\overline{U^2(z)}=\rho a(R-r_d-e)C_D\overline{U^2(z)} \quad (3)$$

where the $C_D$ is the horizontal drag coefficient, and the overline represents the spatial average over approximately $$R-(r_d+\epsilon)\cos(\alpha_0)\simeq R-r_d-\epsilon \quad (4)$$

where R and $r_d$ have design values. The drag on the displaced bottom of the FSB 20 is $$F_d\tfrac{1}{2}\rho(\pi a^2)\sin(\alpha_0)C_dU_d^2=\tfrac{1}{2}\rho\pi a^2C_dU_d^2\alpha_0 \quad (5)$$

Here, the $U_d$ is the current speed that at the center of the bottom. Also, in equations (3) through (5) are the following:

ρ mass-density of salt or fresh water (kg/m²)

a cylinder radius, assuming the collective fin-mass is of second-order (m)

$C_D$ drag coefficient, assumed to be independent of z

U(z) horizontal fluid velocity at $-h\le z\le0$. (m/s)

$C_d$ drag coefficient for the bottom face.

The combination of the second line in eq. (1) and the expressions in equations (2) through (5) yields the following approximate axial-force relationship:

$$-\rho g\pi a^2\epsilon+\alpha C_H](R-r_d)\overline{U^2(z)}-\epsilon U_d^2]\alpha_0+\tfrac{1}{2}\rho\pi a^2C_dU_d^2\alpha_0^2=0 \quad (6a)$$

The approximate expression is a quadratic equation in $\alpha_0$ and a linear equation in ϵ, which is a time-dependent unknown. Solving for the latter of the two dependent variables, it is found that:

$$\varepsilon=\frac{(R-r_d)C_H\overline{U^2(z)}\alpha_0+\frac{1}{2}\pi aC_dU_d^2\alpha_0^2}{\pi ga+C_H\overline{U^2(z)}\alpha_0} \quad (6b)$$

The second equation required to solve for the unknowns $\alpha_0$ and ϵ, is the quasi-static moment expression. Referring to FIG. 7B, that expression is $$K\alpha_0+(F_B-F_B')X_B-(F_H-F_H')Z_H-F_dZ_d-WX_W=0 \quad (7)$$

In this equation, K is the rotational spring constant of the spring-loaded hinge. This is a design value that is based on the static $\alpha_0$ value (15°), as is demonstrated later. The moments are positive in the counterclockwise direction, as is normally the case. Referring, again, to FIGS. 7A-7B, the length expressions are now defined. The first length is from the hydrostatic analysis, and is derived for a vertical circular cylinder in Chapter 11 of the book by McCormick (2010) and elsewhere. That is, $$X_B=\frac{I_{wp}}{V}\sin(\alpha_0)=\frac{a^2}{4d}\sin(\alpha_0)\simeq\frac{a^2}{4d}\alpha_0 \quad (8)$$

Here, $I_{wp}=\pi a^4/4$ is the second moment of the waterplane area with respect to the y-axis of the cylinder, and $V=\pi a^2d$ is the displaced volume. In these values, the fins are neglected. The second length in eq. (7) is:

$$Z_H=\frac{1}{R-(d+\varepsilon)\cos(\alpha_0)}\frac{\int_{R-(d+\varepsilon)\cos(\alpha_0)}^{0}U^2(z)(R+z)\,dz}{\int_{R-(d+\varepsilon)\cos(\alpha_0)}^{0}U^2(z)\,dz}\propto\frac{\int_{R-d-\varepsilon}^{0}U^2(z)(R+z)\,dz}{\int_{R-d-\varepsilon}^{0}U^2(z)\,dz}\equiv Z_H(\varepsilon) \quad (9)$$

The third and fourth terms are:

$$Z_d=(r_d+\epsilon)\cos(\alpha_0)\simeq(r_d+\epsilon) \quad (10)$$

and $$X_W=(r_G+\epsilon)\sin(\alpha_0)\simeq(r_G+\epsilon)\alpha_0 \tag{11}$$

Using the small angle approximations, the combination of equations (8) through (11) with equation (7) results in the following:

$$\left\{K+\frac{1}{4}\rho g\pi a^4\left(1-\frac{\varepsilon}{d}\right)-\frac{1}{2}\rho\pi a^2 C_d U_d^2(r_d+\varepsilon)-\rho g\pi a^2 d(r_G+\varepsilon)]\right\} \tag{12a}$$

$$\alpha_0=\rho a C_H\overline{U^2(z)}(R-r_d-\varepsilon)Z_H(\varepsilon)$$

Hence, the expression for the angle is:

$$\alpha_0=\frac{\rho a C_H\overline{U^2(z)}(R-r_d-\varepsilon)Z_H(\varepsilon)}{\left\{K+\rho g\pi a^2\left[(d-\varepsilon)\frac{a^2}{4d}-\frac{1}{2g}(R-d+\varepsilon)C_d U_d^2-d(r_G+\varepsilon)\right]\right\}} \tag{12b}$$

The small-angle expressions in Equations (6b) and (12b) can be simultaneously solved for both $\alpha_0$ and $\epsilon$, once the current profile U(z) is specified for $Z_H(\epsilon)$ in eq. (9). If the assumption is made that $d>>\epsilon$, then the mean angle expression becomes $$\alpha_0\simeq\frac{\rho a C_D\overline{U^2(z)}(R-r_d)Z_H}{\left[K+\rho g\pi a^2\left(\frac{a^2}{4}-r_G d\right)\right]} \tag{12c}$$

The expression in eq. (12c) is considered to be satisfactory in the preliminary design phase.

B. Determination of the Spring Constant

Concerning the spring constant, K, in equations (6b) and (12b): The purpose of the spring is to give the designer an additional tool in the optimization of the FSB operation by allowing the system to be tuned to some frequency, such as the vortex-shedding frequency. It is somewhat expedient to let K be a multiple of the hydrodynamic restoring coefficient. So, it can be stated that:

$$K=NB_{hydro}=N\rho g\pi a^2(r_B-r_G) \tag{13}$$

Here, N is a design factor, and $r_B$ and $r_G$ are the radial distances from the rotation point to the respective centers of buoyancy and gravity.

C. Operational Equations of Motion

The analysis of vortex-induced vibrations of circular cylinders is normally focused on the transverse vibrations since the in-line vibrations have been observed to be of second-order in most of the practical applications, such as risers. See, for example, Facchinetti, de Langrea and Biolley (2004). Essentially, the vibrating cylinder is treated as a linear spring-mass-damper system excited by vortex shedding in a wake, where the excitation is an equivalent non-linear oscillator described by the van der Pol equation. As is analytically and experimentally demonstrated by Rodenbusch (1978), the van der Pol approach is rather limited.

Figure 6:
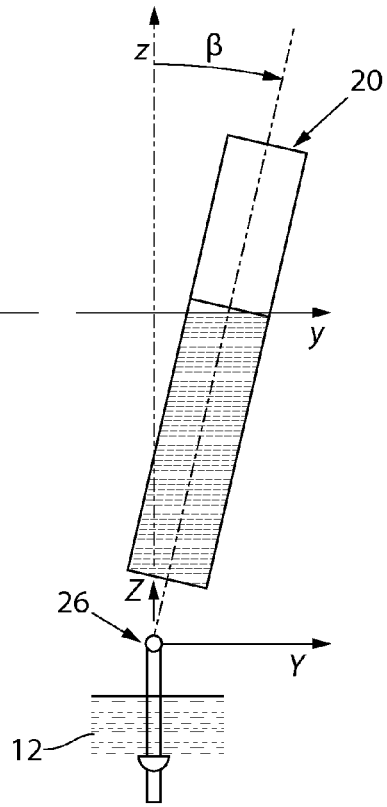
FIG. 6 is a diagram of the other one of the primary rotational planes of the FSB and in particular shows the transverse orientation.

In this Specification, both the in-line and transverse angular motions sketched in FIGS. 5 and 6, respectively, are studied. The maximum amplitude of each time-dependent angular excursion ($\alpha$ and $\beta$) is assumed to be 15° or less, as in the previous two sections. This allows the small-angular limitations to apply. To begin, it is assumed that the damping is nonlinear; however, with the small angle assumption, the equivalent linear damping coefficient can be used, as is described later. Following Rodenbusch (1978), the equations of motion are uncoupled, and are the following:

$$(I_{ym}+I_{yw})\frac{d^2\alpha}{dt^2}+A_{total}\frac{d\alpha}{dt}\left|\frac{d\alpha}{dt}\right|+(K+B_{hydro})\alpha=M_\alpha(t) \tag{14}$$

and $$(I_{xm}+I_{xw})\frac{d^2\beta}{dt^2}+A_{total}\frac{d\beta}{dt}\left|\frac{d\beta}{dt}\right|+(K+B_{hydro})\beta=M_\beta(t) \tag{15}$$

The motions are uncoupled since alpha deflection does not cause beta deflection, and vice versa. Note: The total angle $\alpha$ (in the x-z plane) is comprised of steady and unsteady terms. That is, $\alpha=\alpha_0+\alpha(t)$. The time-dependent term is the most interesting term, as obtained from eq. (14). In the x-z plane, the FSB 20 is displaced at the constant angle $\alpha_0$, as determined in a subsequent section below, entitled "Quasi-Static Angular Displacement in a Steady Current". Further, for this analysis, it is assumed that the current is uniform over R. That is, let $U=U_0$.

Except for the damping coefficient $A_{total}$, the other coefficients in the equations of motion can be directly determined. The damping and lift coefficients, as used in this Specification, are assumed to be experimentally-determined. That is, A-terms are based on the damping test results reported by McCormick and Steinmetz (2011).

Figure 8:
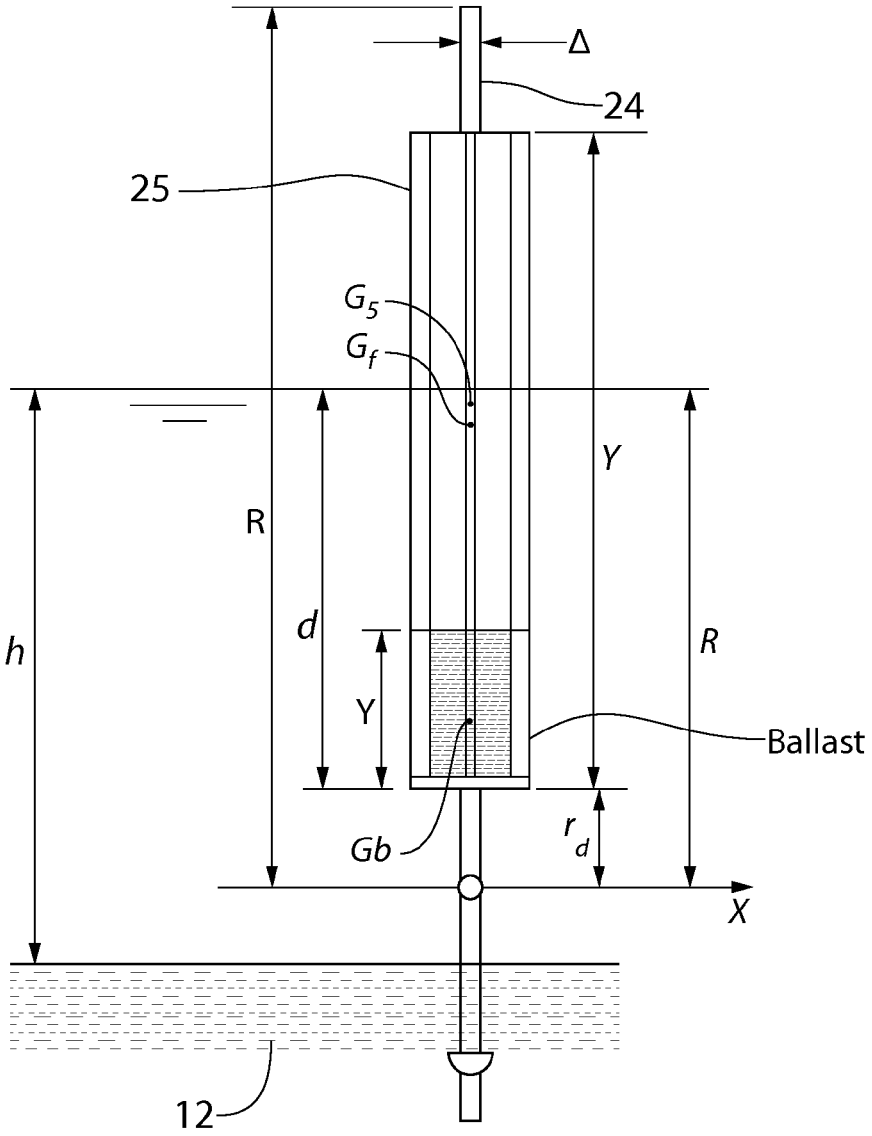
FIG. 8 is a functional diagram of the vertical cross-section of the FSB.

FIG. 8 is a functional diagram of the vertical cross section of the FSB 20. As in FIG. 1, the diameter of the body 25 is D=2a, where a is the radius. The central staff 24 is circular, with a diameter of $\Delta$. The wall thickness of the body 25 is $\tau$, and the cap thicknesses are negligible. Referring to FIG. 8 for notation, the following terms are defined:

$I_{x,ym}$=mass moment of inertia (in N-m-s$^2$/rad) of the body with respect to origin of the hinge coordinates (X Y):

$$\begin{aligned}I_{x,ym}&=I_{float}+I_{ballast}+I_{staff}\\&=(I_{float-Gf}+m_{float}r_{Gf}^2)+(I_{ballast-Gb}+M_{float}r_{Gb}^2)+\\&\quad(I_{staff-Gs}+m_{staff}r_{Gs}^2)\end{aligned} \tag{16}$$

Here, the terms in each bracket in the second line are the moment of inertia about the hinge, found by applying the parallel axis theorem. The right-hand side components in eq. (16) are mass moments of inertias of the float (a capped circular cylindrical tube), the ballast (a circular cylindrical disk) and the staff (a small-diameter shaft), respectively. The first terms in the brackets are the mass moment of inertia terms with respect to the centers of gravity (Gf, Gs, Gb). These are, respectively, the following:

$$\begin{aligned}I_{float}&=\frac{1}{12}m_{float}\{3[a^2+(a-\tau)^2]+Y^2]\\I_{ballast}&=\frac{1}{4}m_{ballast}\left[(a-\tau)^2+\frac{1}{3}Y^2\right]\\I_{staff}&=\frac{1}{12}m_{staff}R^2\end{aligned} \tag{17}$$

Note: The float-term does not include the mass of the thin fins. As the number of fins increases, this assumption becomes less valid.

$I_{x,yw}$=added-mass moment of inertia with respect to the x- or y-axes (N-m-s$^2$/rad) of an N-fin FSB:

$$I_{x,yw} = \frac{1}{2}m_w(b^2 + a^2) + m_w\left(r_d + \frac{d}{2}\right)^2 \tag{18}$$

Here, it is assumed that the shape of the added-mass is a thick circular tube, having an inner radius of a and an outer radius of b. The approximation is due to the exclusion of the lower exposed portion of the staff 24, which is negligible when compared to the right-hand term in eq. (18). Using the results of Bryson (1954), as discussed by Sarpkaya and Isaacson (1981) and others, the added-mass ($m_w$) of the FSB 20 is $$m_w = m_w' d = \rho\pi a^2\left\{2^{\frac{N-4}{N}}\left(\frac{b}{a}\right)^2\left[1 + \left(\frac{a}{b}\right)^N\right]^{\frac{4}{N}} - 1\right\}d \tag{19}$$

where N is the number of fins, with the condition that N≥3, and $m_w'$ is the added-mass per unit length of the submerged portion of the float. The expression for $m_w'$ is due to Bryson (1954) who conformally maps a slender body with fins onto a circle, as is done by Miles (1952) in a study of the interference of fins on body. In eq. (19), the fin radius form the centerline of the float is b=a+δ is the fin radius, as sketched in FIG. 1. For the body in FIGS. 1-3, N=8. The Miles (1972) and Bryson (1954) studies are applied to 2-dimensional bodies; hence, the use in this 3-dimensional analysis is approximate.

Figure 9:
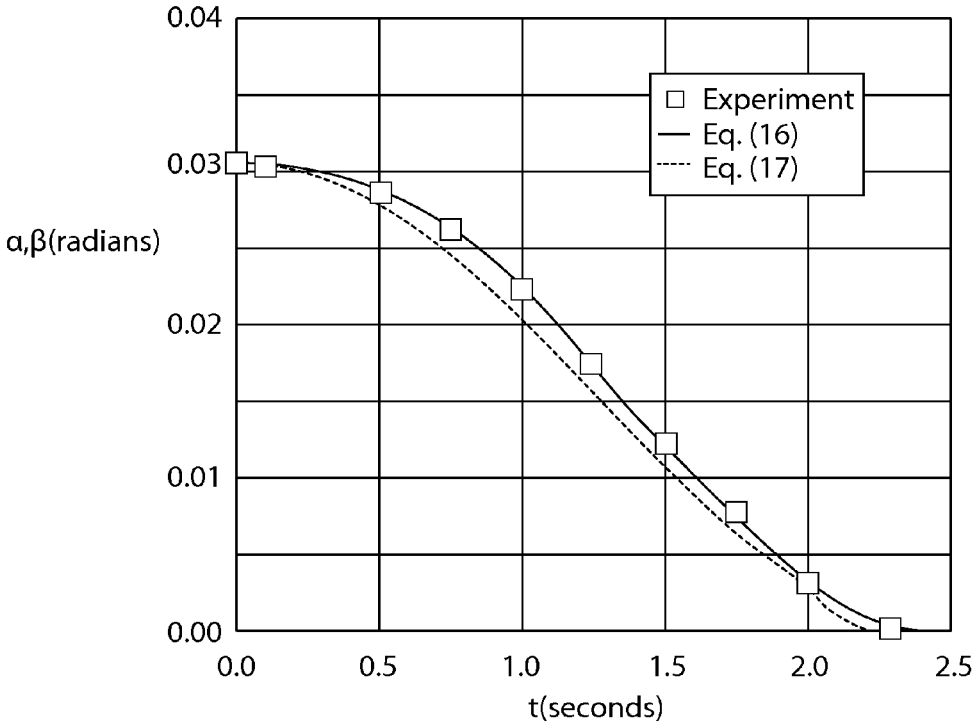
FIG. 9 is a plot of calm-water angular damping experimental data and empirical curves.

In order to obtain the expression for the damping coefficient ($A_{total}$), the experimental damping test results of McCormick and Steinmetz (2011) and McCormick and Murtha (2012) have been used to show that the damping is non-linear. These data are presented in FIG. 9. The to configuration in the tests of FIG. 9 was that of a buoy designed for wave-energy absorption and attenuation, such as that disclosed in U.S. Patent Publication No. 2011/0299927 (McCormick, et al.). The empirical expression in eq. (16) is valid over the time range of 0≤t≤2.3 s, while that in eq. (17) applies over 2.5 s. Also presented in FIG. 9 are two empirical curves. The first of these is obtained by fitting the data to the ten-polynomial:

$$\begin{aligned}\alpha &= \alpha_0 + a_1 t + a_2 t^2 + \ldots + a_9 t^9 \\ &= \sum_{j=0}^{j=9} a_j t^j \\ &\simeq 0.030475 - 0.007056t + 0.074762t^2 - 0.379672t^3 + \\ &\quad 0.895930t^4 - 1.181685t^5 + 0.899251t^6 - \\ &\quad 0.391418t^7 + 0.090462t^8 - 0.008604t^9\end{aligned} \tag{20}$$

The second empirical equation is the trigonometric representation, $$\alpha \simeq \alpha_0\cos^2\left(\frac{2\pi}{4t_0}t\right) = \alpha_0\cos^2(\omega_0 t) \tag{21}$$

The time, $t_0$, in this expression is 2.5 s, and is assumed to be a pseudo quarter-period ($T_0=2\pi/\omega_0$) of an oscillation. The circular frequency ($\omega_0$) is, then, a damped natural period. The experimental initial conditions were $\alpha|_{t=0}\equiv\alpha_0\approx0.305$ rad and $d\alpha/dt|_{t=0}=0$. The second of these is approximately satisfied by eq. (20) if $\alpha_1$=0.007056 rad/s, and is exactly satisfied by the expression in eq. (21). Furthermore, from eq. (20), the initial angular acceleration is $d^2\alpha/dt^2|_{t=0}=2a_2\approx0.150$ rad/s$^2$. The initial acceleration predicted by eq. (21) is $d^2\alpha/dt^2|_{t=0}=-2\alpha_0\omega_0^2\approx-0.492$ rad/s$^2$ Since the use of eq. (20) is somewhat unwieldy, the expression in eq. (21) is used. From the results shown in FIG. 9, a small sacrifice in accuracy is expected.

$A_{\alpha,\beta}$≡total damping coefficients. With it assumed that the system damping is proportional to the square of the velocity, the in-line damping moment at any time can be written as follows:

$$\begin{aligned}A_\alpha\frac{d\alpha}{dt}\left|\frac{d\alpha}{dt}\right| &\simeq \frac{1}{2}\rho C_D D\int_{r_d}^{R} Z\left(Z\frac{d\alpha}{dt}\right)\left|Z\frac{d\alpha}{dt}\right|dZ \\ &= \frac{1}{8}\rho C_D(D + 2\delta)(R^4 - r_d^4)\frac{d\alpha}{dt}\left|\frac{d\alpha}{dt}\right|\end{aligned} \tag{22}$$

From this relationship, the $A_\alpha$ relationship is found directly. In a similar manner, $A_\beta$ is found, where the drag coefficient is replaced by the lift coefficient. For both the drag and the lift coefficients, then, the following can be written:

$$A_{\alpha,\beta}=\tfrac{1}{8}\rho C_{D,L}(D+2\delta)(R^4-r_d^4) \tag{23}$$

Where $C_D$ and $C_L$ are the time-averaged respective drag and lag coefficients. In view of the lack of, or little, drag or lift data for the FSB 20 geometry, values are assumed which relate to components of the FSB 20 geometry. It is assumed that the A-terms represent the sum of the wake-associated and the radiation losses. The free-surface associated with the former would resemble the CFD-results presented in FIGS. 10A and 10B; while the latter is due to the surface waves produced by the FSB motions.

In the determination of α(t) and β(t), the linear-equivalent damping and lift coefficients are used. To determine these, equations (14) and (15) are, first multiplied by the assumed linear angular velocity of the form:

$$\frac{d\theta}{dt} = \omega\,\underline{\theta}\cos(\omega t) \tag{24}$$

and then the resulting relationship is averaged over one quarter-period. The notation θ represents either α or β, as appropriate. The resulting linear coefficients are found to be:

$$A_{lin-\alpha,\beta} = \frac{\frac{4}{T}A_{\alpha,\beta}\int_0^T\left(\frac{d\theta}{dt}\right)^3 dt}{\frac{4}{T}\int_0^T\left(\frac{d\theta}{dt}\right)^2 dt} = \frac{8}{3\pi}\omega_{v-\alpha,\beta}\underline{\theta}_{\alpha,\beta}A_{\alpha,\beta} = A_{\alpha,\beta}\omega_{v-\alpha,\beta}\underline{\theta}_{\alpha,\beta} \tag{25}$$

The frequencies for the forced motions differ by a factor of two. From Sobey and Mitchell (1977), the in-line frequency is $2\omega_v$; whereas, the transverse frequency of motion is $\omega_v$, the vortex-shedding frequency. The method used to obtain the equivalent linear damping coefficients can be found in the book by McCormick (2010), among others. In eq. (25), the last coefficients are used for simplification. Those coefficients, $A_\alpha$ and $A_\beta$ appear extensively in a subsequent section below, where the quasi-linear in-line and transverse motions are analyzed.

Figure 10A:
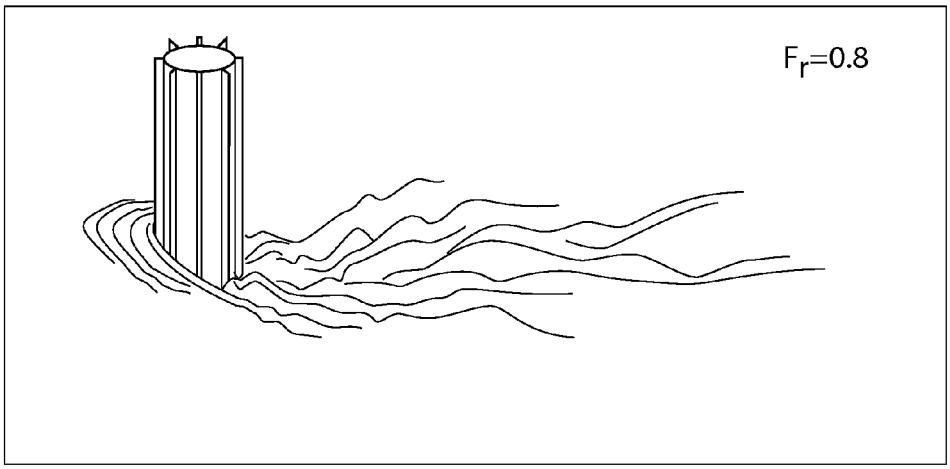
FIG. 10A is a computational fluid dynamic result of a rigid FSB in a uniform flow exhibiting a Froude Number of 0.8.
Figure 10B:
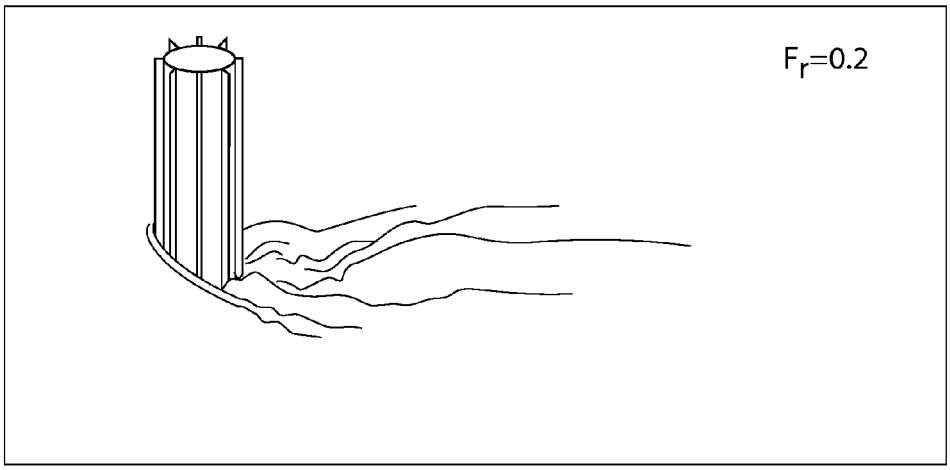
FIG. 10B is a computational fluid dynamic result of a rigid FSB in a uniform flow exhibiting a Froude Number of 0.2.

It should be noted that the parameter in FIGS. 10A-10B is the Froude number based on the mean diameter:

$$F_r = \frac{U}{\sqrt{gD}} \tag{26}$$

where D (=D+2δ) is the fin diameter in FIG. 1. FIGS. 10A-10B are modified versions of those of Sue, Yang and Stern (2011), which result from a CFD analysis of smooth vertical cylinders.

The drag coefficient for a rigid, surface-piercing body depends on both the Reynolds number, U(D+2δ)/ν=UD/ν, and the Froude number in eq. (26), beneath FIGS. 10A/10B. Since the viscous effects and free-surface (gravitational) effects cannot be scaled simultaneously, experimental data must be used for the FSB 20. The values used herein are those for a flat plate which is normal to the flow. Hence, the values are a rough approximation for the FSB 20.

In eq. (23) are the following restoring coefficients:

$B_{hydro}$=hydrostatic restoring moment coefficient (N-m-s/rad):

$$B_{hydro} \simeq \rho g \pi a^2 d(r_B - r_G) \tag{27}$$

from McCormick and Murtha (2012). In eq. (27), $r_B$ is the radius to the center of buoyancy, and $r_G$ is the radius to the center of gravity of the buoy. The expression in eq. (27) is based on the small-angle assumption, previously discussed. Also in eq. (23a) is:

K=rotational spring constant (N-m-sfrad): From eq. (14), $$K = NB_{hydro} \tag{28}$$

where N is a design constant required to achieve a near-resonance condition with the vortex-shedding frequency, $f_v$.

The exciting moments in equations (14) and (15) are primarily due to the vortex-shedding. Sobey and Mitchell (1977) state that the time-dependent drag exciting moment has twice the frequency of the vortex shedding; whereas, the exciting moment in the transverse vertical plane (y-z) has the vortex-shedding frequency ($f_v$). Following Sobey and Mitchell (1977), the exciting moment in eq. (14) is, then, $$\begin{aligned} M_\alpha(t) &= \frac{1}{4}\rho U^2 C_D (R^2 - r_d^2)\sin(4\pi f_v t) \\ &= \frac{1}{4}\rho U^2 C_D (R^2 - r_d^2)\sin(2\omega_v t) = M_{\alpha 0}\sin(2\omega_v t) \end{aligned} \tag{29}$$

assuming a vertically-uniform current from Z=0 to Z=R. In eq. (28), $C_D$ is a time-average drag coefficient.

Following both Sobey and Mitchell (1977) and Rodenbusch (1978), for the vertically-uniform current, the transverse exciting moment is expressed by $$M_\beta(t) = \tfrac{1}{4}\rho U^2 C_L (R^2 - r_d^2)\sin(\omega_v t) = M_{\beta 0}\sin(\omega_v t) \tag{30}$$

In this equation, $C_L$ is the time-averaged lift coefficient. For the FSB 20, information on the values of the lift and drag coefficients are not available. For the former, it is assumed that the vortex shedding along the length of the buoy is well-correlated, and is predicted by the small-amplitude formula, $$C_L = 0.35\sqrt{\frac{4}{3}\frac{L_{cor}}{d}} = 0.404 \tag{31}$$

This equation is an approximation of that presented in Table 3-1 in the book of Blevins (1990), where correlation length ($L_{cor}$) is along the axis of a pivoted circular rod, which is similar to that sketched in FIG. 8 without the fins. The drag coefficient is experimentally determined from eq. (23).

The moments due to the exposed portion of the staff (from Z=0 to Z=$r_d$) are assumed to be negligible. The steady-state solutions of equations (14) and (15) are of interest here. It is of interest to note that according to Rodenbusch (1978), "a constant Strouhal number, for steady flow, implies that a pair of vortices is shed every time a fluid particle in the free stream travels a certain number of vortices". That length, from Rodenbusch (1978), is $D/S_{tv}$, where $S_{tv}$ is the Strouhal number for the vortex-shedding frequency. That is, $S_{tv}=f_v U/D$, where D is the defined in FIG. 1.

D. In-Line and Transverse Motions of the FSB

The terms in the respective in-line and transverse equations of motion, equations (14) and (15), have been defined. By replacing the nonlinear damping coefficient by the equivalent linear damping coefficient in eq. (25), the equation are a set of uncoupled, linear, second-order non-homogeneous equations having steady-state solutions as follows:

$$\alpha(t) = \frac{M_{\alpha 0}/(K + B_{hydro})}{\sqrt{\left[1 - \left(2\frac{\omega_v}{\omega_n}\right)^2\right]^2 + \left(8\frac{A_\alpha}{A_{cr}}\frac{\omega_v^2}{\omega_n}\underline{\alpha}\right)^2}}\sin(2\omega_v t + \phi_\alpha) = \underline{\alpha}\sin(2\omega_v t + \phi_\alpha) \tag{32}$$

where α is the motion amplitude in the x-z plane, $\omega_v=2\omega_v$ and $$\beta(t) = \frac{M_{\beta 0}/(K + B_{hydro})}{\sqrt{\left[1 - \left(\frac{\omega_v}{\omega_n}\right)^2\right]^2 + \left(2\frac{A_\beta}{A_{cr}}\frac{\omega_v^2}{\omega_n}\underline{\beta}\right)^2}}\sin(\omega_v t + \phi_\beta) = \underline{\beta}\sin(\omega_v t + \phi_\beta) \tag{33}$$

where β is the amplitude in the transverse (y-z) plane. In these equations are the critical damping coefficient, defined by $$A_{cr} = 2\sqrt{(I_{ym} + I_{ym})(K + B_{hydro})} \tag{34}$$

and the natural circular frequency, defined by $$\omega_n = \sqrt{\frac{(K + B_{hydro})}{(I_{ym} + I_{yw})}} \tag{35}$$

Also in the respective equations (32) and (33) are the phase angles between the excitation moments and the motions, $$\phi_\alpha = \tan^{-1}\left(8\frac{\frac{A_\alpha}{A_{cr}}\frac{\omega_v^2}{\omega_n}\underline{\alpha}}{1 - \left(2\frac{\omega_v}{\omega_n}\right)^2}\right) \tag{36}$$

where, again, $\omega_v=2\omega_v$, and $$\phi_\beta = \tan^{-1}\left(2\frac{\frac{A_\beta}{A_{cr}}\frac{\omega_v^2}{\omega_n}\underline{\alpha}}{1-\left(\frac{\omega_v}{\omega_n}\right)^2}\right) \tag{37}$$

See McCormick (2010) and others for derivations of equations (32) through (37). A comparison of equations (36) and (37) shows that the difference in the two phase angle expression is in the numerical coefficients resulting from the in-line and transverse vortex-shedding frequencies, and the quasi-linear damping coefficients, $A_\alpha$ and $A_\beta$. One final note on the equivalent linear responses in equations (32) and (33): The coefficients of the sine terms both contain the amplitudes, which are $\underline{\alpha}$ in (32) and $\underline{\beta}$ in (33). Hence, their expressions result from the solutions from quadratic equations, which are the following:

$$\underline{\alpha} = \sqrt{-\frac{\left[1-\left(2\frac{\omega_v}{\omega_n}\right)^2\right]^2}{2\left(8\frac{A_\alpha}{A_{cr}}\frac{\omega_v^2}{\omega_n}\right)^2} + \frac{1}{2\left(8\frac{A_\alpha}{A_{cr}}\frac{\omega_v^2}{\omega_n}\right)^2}\sqrt{\left[1-\left(2\frac{\omega_v}{\omega_n}\right)^2\right]^4 + 4\left(8\frac{A_\alpha}{A_{cr}}\frac{\omega_v^2}{\omega_n}\right)^2\left(\frac{M_{\alpha 0}}{K_{B_{hydro}}}\right)^2}} \tag{38}$$

where, again, $\omega_{V'}=2\omega_v$ and $$\underline{\beta} = \sqrt{-\frac{\left[1-\left(\frac{\omega_v}{\omega_n}\right)^2\right]^2}{2\left(2\frac{A_\beta}{A_{cr}}\frac{\omega_v^2}{\omega_n}\right)^2} + \frac{1}{2\left(2\frac{A_\beta}{A_{cr}}\frac{\omega_v^2}{\omega_n}\right)^2}\sqrt{\left[1-\left(\frac{\omega_v}{\omega_n}\right)^2\right]^4 + 4\left(2\frac{A_\beta}{A_{cr}}\frac{\omega_v^2}{\omega_n}\right)^2\left(\frac{M_{\beta 0}}{K+B_{hydro}}\right)^2}} \tag{39}$$

Figure 11:
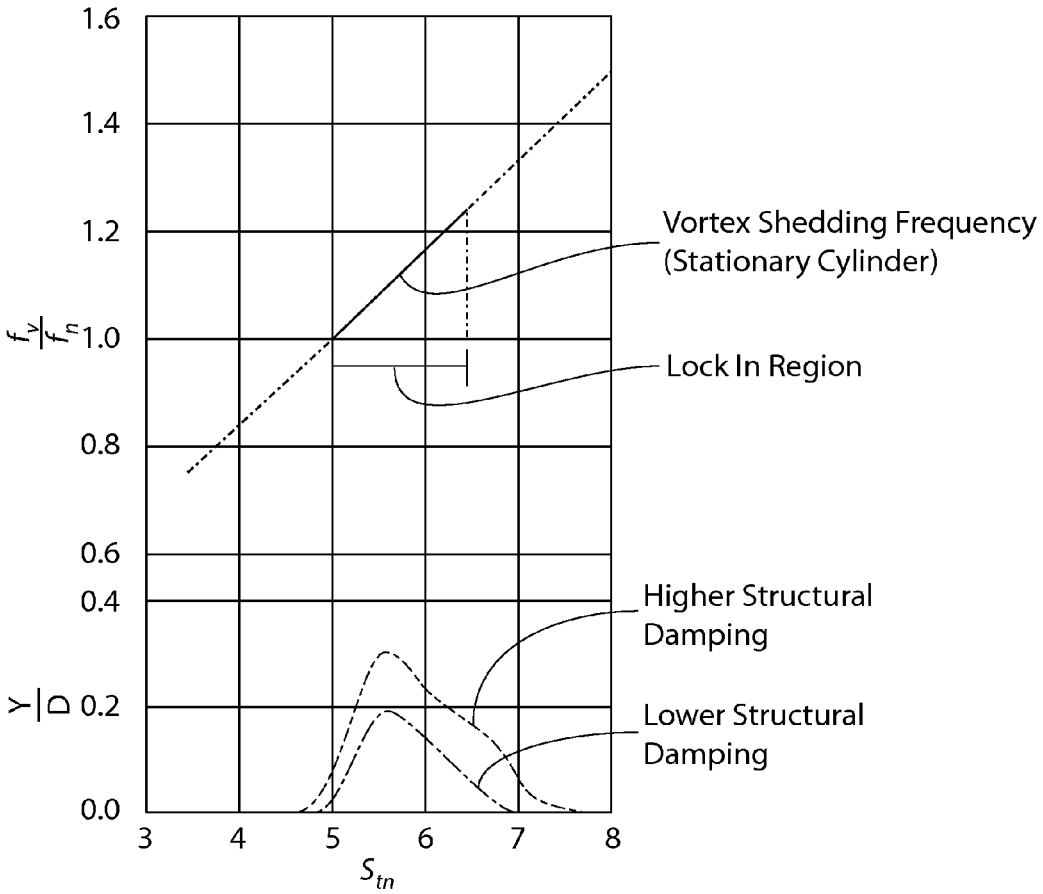
FIG. 11 is the shedding frequency ratio and amplitude ratio vs. Strouhal Number for a Two-Dimensional Circular Cylinder.

The relationship between the vortex shedding frequency and the natural frequency is similar to that in FIG. 11. In that figure, both the transverse amplitude ratio (rβ/D) and the frequency ratio ($\omega_v/\omega_n$) are presented as functions of the Strouhal number based on the natural frequency. That is, $$S_{tn} = \frac{U}{f_n D} \tag{38}$$

The Reynolds number for given values of D(=D+2*) and U is obtained from $$R_e = \frac{UD}{\nu} \tag{39}$$

where ν is the kinematic viscosity. In equations (38) and (39), the diameter is the mean of the fin and buoy diameters. The relationship between the Strouhal number and the Reynolds number for the FSB must be obtained. For the example in Section 4, the smooth cylinder data presented in FIG. 2.15 of McCormick (2010) can be used.

With particular regard to FIG. 11, it should be noted that the motions for which the frequency ratio (top figure) and the amplitude ratio (bottom figure) are for a circular cylinder moving in a direction normal to the flow. The curves are based on the Feng (1968) data, as presented by Blevins (1990). The lock-in phenomenon is shown to occur at resonance over an approximate Strouhal number (based on the natural frequency) range of from 5 to 6.5. The curves do not apply directly to the FSB 20, and are presented to illustrate behavior. It is not known at this time if the FSB 20 experiences lockin. The curves are used to illustrate the analysis of the FSB 20 presented in this Specification.

E. Energy Extraction Rate and Capture Width

Figure 12:
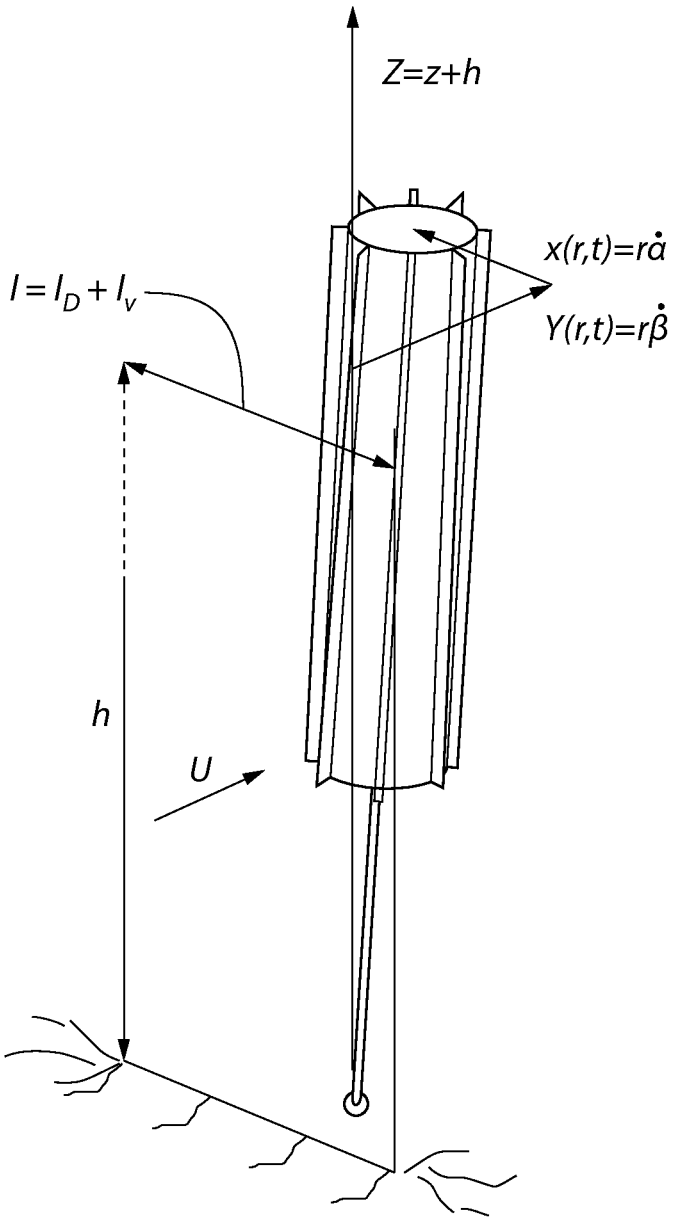
FIG. 12 is a diagram of the FSB in a uniform steady flow.

As illustrated in FIG. 12, the influence of the FSB 20 on the current is measured in terms of a capture width, $$l=l_D+l_v,$$

where $l_D$ is that due to both the wave-making and wake drag; while, $P_v$, is the width due to the vortex shedding. In other words, the capture width is an equivalent width; that is, the kinetic energy of the current that is affected can be represented by that of the flow through the vertical area (capture width times water depth, as shown in FIG. 12) that is normal to the unaffected flow direction. The first of these components is obtained from energy flux equation, $$\tfrac{1}{2}\rho C_D U^3(D+2\delta)d=\tfrac{1}{2}\rho U^3 h l_D \tag{40}$$

where the current velocity, U, is assumed to be uniform from the free-surface down to the bed. The second capture width component, $P_v$, due to the vortex-induced motions of the FSB 20 results from the time-rates of change of the kinetic energies of the current and the body must be compared. The time rate of energy absorbed by the FSB and lost by the current from the in-line and transverse motions over one motion-cycle is as follows:

$$\frac{1}{T_v}\int_0^{T_v}\left[A_\alpha\left(\frac{d\alpha}{dt}\right)^2 + A_\beta\left(\frac{d\beta}{dt}\right)^2\right]dt = \left(2A_\alpha\underline{\alpha}^2 + \frac{1}{2}A_\beta\underline{\beta}^2\right)\omega_v^2 = \frac{1}{2}\rho U^3 h\ell_v \tag{41}$$

where $A_\alpha$ and $A_\beta$ are obtained from eq. (25). The last equality might be thought of as analogous to the Betz (1966) equation for the power extraction by turbines.

By solving equations (40) and (41) for the component widths, and combining the results, the following expression for the total capture width is obtained:

$$\ell = \ell_D\ell_v = C_D(D+2\delta)\frac{d}{h} + \frac{(8A_\alpha\underline{\alpha}^2 + A_\beta\underline{\beta}^2)\omega_v^2}{\rho U^3 h} \tag{42}$$

This capture width is a measure of performance of the FSB 20. An application of the analysis leading to the expression in eq. (42) is presented later in this Specification.

Performance Calculation Procedure

The performance of the FSB 20 is determined by the capture width, P, sketched in FIG. 12, and determined from eq. (38). The procedure in the determination of P is as follows:

(1) Experimentally determine the damping coefficient. In the analysis, the experimental (nonlinear) damping coefficient in eq. (23) is determined from the still-water motions of the FSB 20 from an initial displacement, $\alpha_0$. For the FSB, the still-water response is assumed to be similar to that presented in eq. (21), which leads to the results in eq. (23).

(2) Determine the linear-equivalent damping coefficient. The coefficient, $A_{lin}$, is determined from eq. (25). In that equation, the restoring coefficient components, $B_{hydro}$ and K, are determined from equations (27) and (28), respectively.

(3) Determine the inertial coefficients. The mass moments of inertia of the FSB with respect to the point of rotation are determined using equations (16) through (19).

(4) Determine the critical damping and natural circular frequency. These are found in equations (34) and (35), respectively.

(5) Determine the phase angles. These are obtained from equations (36) and (37).

(6) Determine the vortex-shedding frequency. By considering the Strouhal number in eq. (38), which is a function of the Reynolds number in eq. (39), as a known, the value of $f_v$ is determined. Since there are no data available as yet for the FSB 20, the straight-line approximation for the top graph in FIG. 11 is used. That is, $$f_v=0.1667(1+S_m)f_n \tag{43}$$

(7) Determine the exciting moments. The exciting moments depend on the lift and drag coefficients respectively presented in equations (31) and (24). The lift coefficient in eq. (31) is a rough value based on a circular cylinder FSB 20 without fins. The drag coefficient is depends on the experimentally determined parameters of the system.

(8) Determine the in-line and transverse responses as a function of time. These respective angular displacements are determined from equations (32) and (33), respectively.

(9) Determine the capture width, P. This length is found in eq. (40), and is seen to be a function of the angle amplitudes, $\alpha$ and $\beta$. These, in turn, are obtained in step (8).

As for FIG. 12, for the derivation, the current velocity (U) is both uniform and steady. The water depth is h, and the capture width (P) of the current is to due to both the wake and wave losses for the rigid body ($P_D$) and those due to the vortex-induced vibrations ($P_D$).

EXAMPLE

Sand bars in the Mississippi-Missouri river system pose navigation problems for the mariners on the rivers. As stated earlier, these bars are normally marked by fast-water buoys by the U. S. Coast Guard. Unfortunately, these buoys are at times lost due to either boat collisions or extreme flow events. In addition, the bars appear, disappear and migrate near river bends. As a result, a fast-water buoy might be at a site formerly occupied by a bar. The new position of the bar would, then, be unmarked and, as a result, the bar would be a navigation hazard.

In the Mississippi-Missouri river system, the approximate nominal current range is from 3 ft/s to 10 ft/s. Consider the deployment of an 8-fin FSB in 6 feet of water, where the current is uniform from the bed to the free surface. Referring to the sketch in FIG. 1, the draft (d) of the FSB is 5.5 ft, and the spring-loaded hinge is at z=−R=−6 ft. That is, the point of rotation is on the bed. The free-board of the FSB is 3 ft. The buoyant cylinder diameter (D) is 1 ft, and the fin width (*) and thickness are 4 in and 1 in, respectively. Assuming that the water is fresh at 60° F., the respective weight-density and the kinematic viscosity of the water are ($\rho$=62.4 lb/ft$^3$ and <=1.210×10$^5$ ft$^2$/s). The center of gravity of the FSB is at $Z_G$=4.25 ft (above the center of rotation). The other properties of the FSB are as follows:

a (buoy radius)=0.5 ft
$A_{total}$ (nonlinear damping coefficient)=2,887 ft-lb-s$^2$/rad$^2$
$A_{cr}$ (critical damping coefficient)=3,054 ft-lb-s/rad
$A_{lin}$ (linear equivalent damping coefficient)=543 ft-lb-s/rad
b (fin radius)≈0.833 ft
$B_{hydro}$ (hydrostatic restoring moment coefficient)=159 ft-lb
$C_D$ (drag coefficient)≈2.0 (flat plate approximation)
$C_L$ (lift coefficient)≈0.404 (circular cylinder approximation)
d (buoy draft)=5.5 t
D=2a (buoy diameter)=1 ft
$f_n$ (natural frequency)=0.60 Hz
$f_v$ (vortex-shedding frequency)=0.60 Hz
g (gravitational acceleration)=32.2 f/s$^2$
h (water depth)=6 ft
$I_m$ (FSB mass moment of inertia with respect to the rotation point)=129 ft-lb-s$^2$
$I_w$ (added-mass moment of inertia with respect to the rotation point)=277 ft-lb-s$^2$
K (rotational spring constant)=N$B_{hydro}$=35*159=5,575 ft-lb
m (buoy mass)=10.7 lb-s$^2$/ft
$m_w$ (added-mass)=24.8 lb-s$^2$/ft
$M_{\alpha 0}$ (in-line moment amplitude)=866 ft-lb
$M_{\beta 0}$ (transverse moment amplitude)=175 ft-lb
N (design coefficient for spring constant)=35
N (number of fins)=8
$W_{FSB}$ (FSB floating weight)=346 lbs
$W_{bal}$ (concrete ballast weight)=0 lbs (unballasted)
$Z_B$=(height to center of buoyancy above the center of rotation)=3.25 ft
$Z_{float}$ (height of the FSB)=7.5 ft
$Z_G$=(height to center of gravity above the center of rotation) =4.25 ft (assuming 3 ft freeboard)

Figure 13:
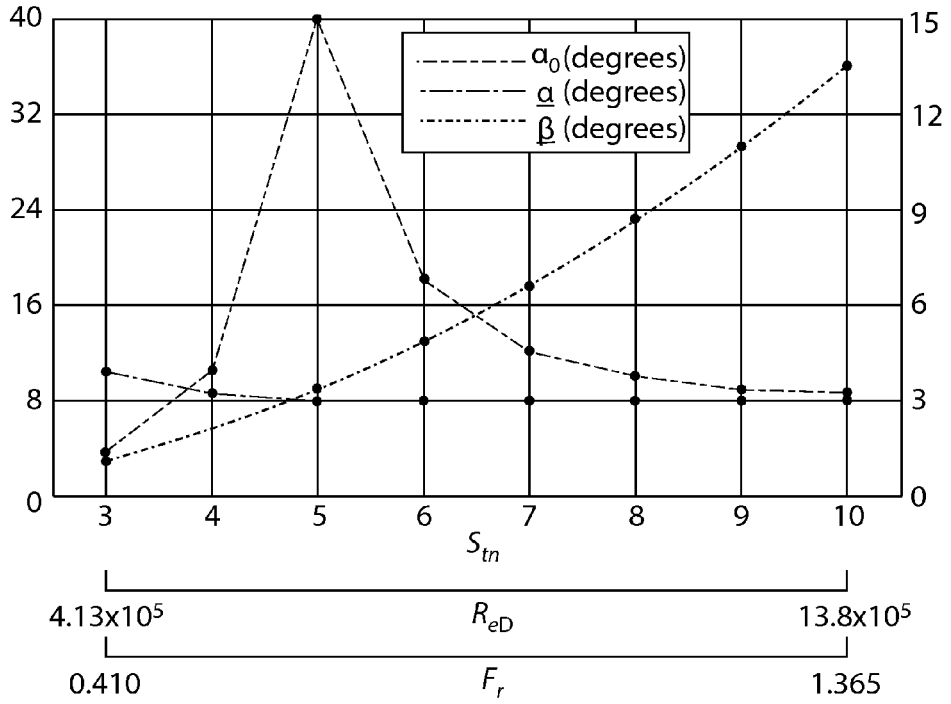
FIG. 13 is a plot of the static and dynamic angular amplitudes of the FSB.

For this FSB in the 6-feet of fresh water, the mean in-line deflection angle ($\alpha_0$) and the angular displacements ($\alpha$ and $\beta$) of the respective in-line and transverse angular motions are shown in FIG. 13 as functions of the natural-frequency Strouhal number ($S_m$), the Reynolds number ($R_{eD}$) and the Froude number ($F_r$) for current speeds of from 3 fps to 10 fps. The results in that figure are obtained from the approximate expression in eq. (12c) for $\alpha_0$. One sees that the predicted maximum static angular deflection is approximately 36°. If the buoy is rigidly attached to the staff, then there is no axial movement, and the top of the buoy (having a free-board of 2 ft in still water) is just above the free-surface for the maximum angle. In reality, the buoy will slide outward from the center of rotation due to both buoyancy and the additional axial stress due to the viscosity. The maximum value of the amplitude of the in-line angular motions ($\underline{\alpha}$) occurs at the lowest speed, and continuously decreases as the non-dimensional numbers increase. The amplitude of the transverse angular motions ($\underline{\beta}$) appears to resonate in the region of a natural-frequency Strouhal number equal to 5. Because of the whole number speeds used to determine the non-dimensional numbers, the actual peak value of the $\underline{\beta}$-curve in FIG. 13 is not evident. That is, the actual peak could occur on either side of the shown maximum value.

It should be noted that in FIG. 13 that the angular values in this figure are all in degrees. The static deflection values are on the left; while, the dynamic amplitudes are on the right. The maximum value of the transverse angular amplitude is approximately 15°, which is the upper limit of the small-angle assumption. A further computation of the transverse angular value for velocities increasing by 0.1 fps shows that the maximum value shown in the figure is, in fact, the approximate peak.

The non-dimensional capture width (P/D) is presented in FIG. 12 as functions of the Strouhal number based on the natural frequency, the Reynolds number and the Froude number. In FIGS. 10A-10B, it can be seen that the Froude number for the top figure is in the high Strouhal number region studied, over which the capture width changes slightly with increasing current speed. For the lowest speeds, the capture width is approximately 1.9 times the fin diameter (D=D+2*). The width gradually decreases to about 1.83 over the speed range. A comparison of the capture width curve in FIG. 14 with the in-line amplitude curve in FIG. 13 shows that both parameters have the same behavior.

Figure 14:
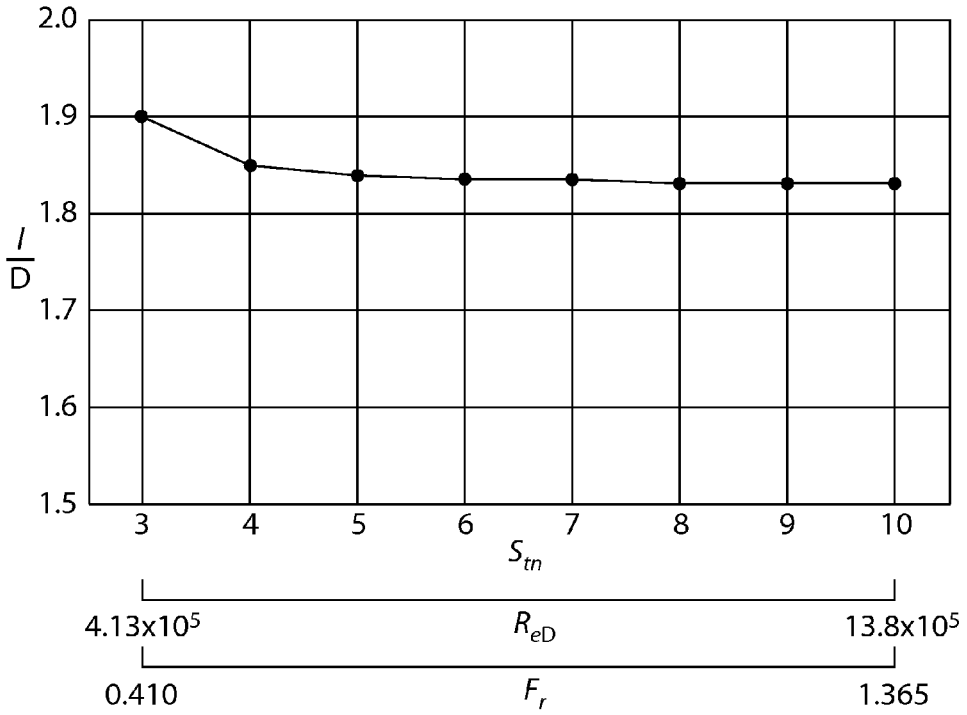
FIG. 14 is a plot of the capture width ratio versus Strouhal, Reynolds and Frounde Numbers.

It should be noted that in FIG. 14, the capture width (P), shown in FIG. 10, is the sum of that due to the steady current past a rigid FSB and that due to the motions of the body. The diameter used to non-dimensionalize the capture width is that of the body plus fins. That is, referring to FIG. 1, D=2b=D+26.

Discussion and Conclusions

The analysis of the performance of the FSB is based on a virtual cross-current width, called the capture width. The analysis shows that this width is between 1.8 and 1.9 times the fin width (D in FIG. 1). The width is simply a measure of the amount of current energy is influenced by a single FSB. For a practical application, a number of units would be deployed. For the Mississippi-Missouri river system discussed above, five units, for example, would transform the current energy over a 24-foot width. It can be concluded that this passive method of water current control is both viable and environmentally acceptable.

Figure 15:
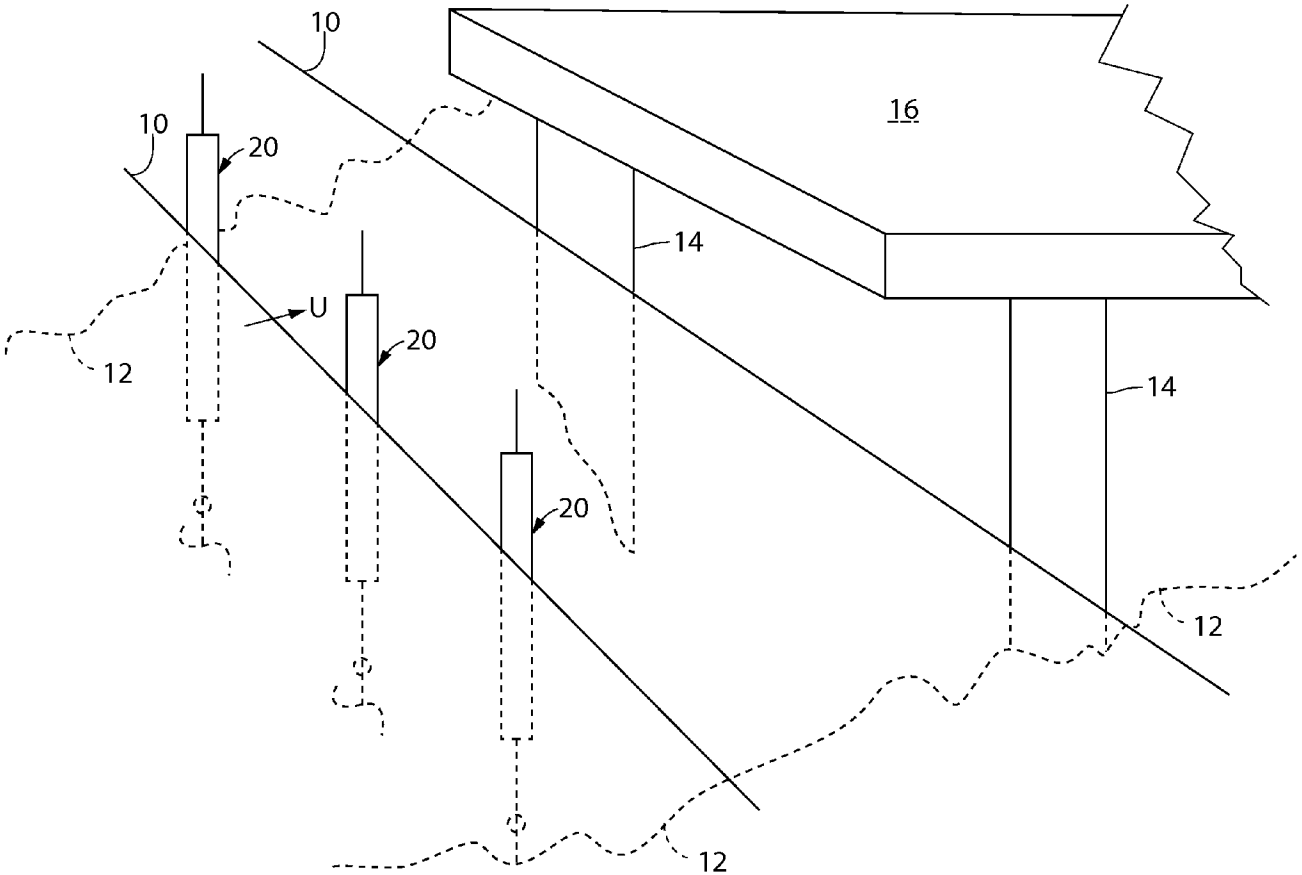
FIG. 15 is a diagram depicting an exemplary FSB array positioned upstream of a dock, shown in partial.

For example, as shown in FIG. 15, a plurality of FSBs 20 are positioned upstream of a dock 16 having pilings 14. These FSBs 20 (a plurality of which form an array 20A of FSBs) act together to temper the effects of steady currents 10, in accordance with all of the above analyses. Anchored in the stream bed 12, the array 20A acts to deplete the stream current energy and, thereby, protect the pilings 14 from the heavy stream current.

Figure 16A:
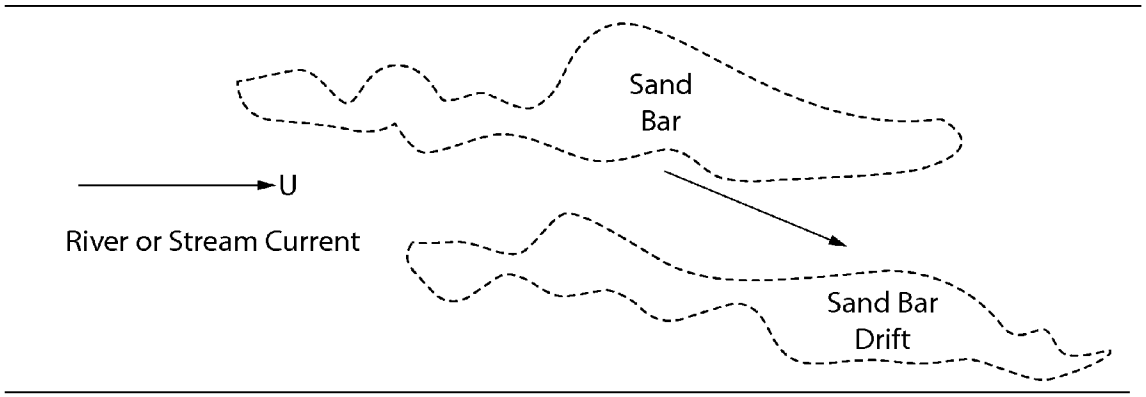
FIG. 16A is a functional plan view of a stream showing an underwater sand bar that tends to drift over time due high stream current energy.
Figure 16B:
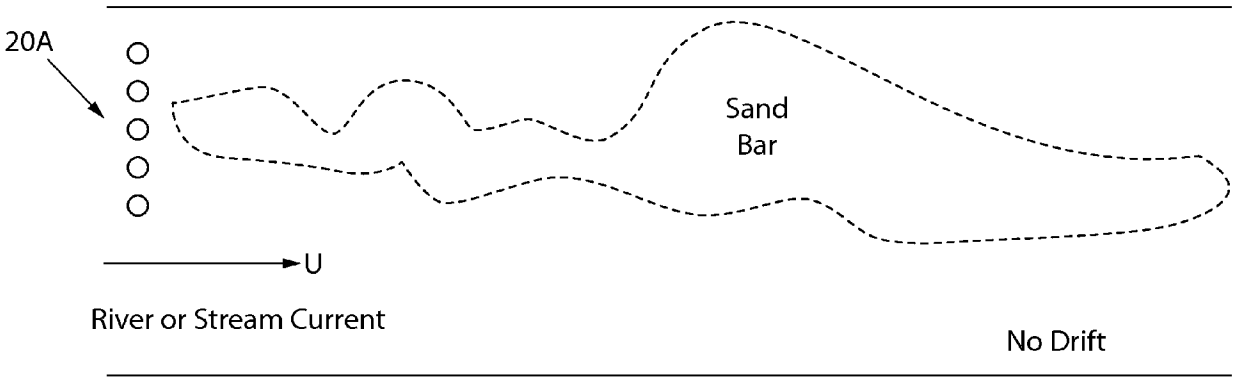
FIG. 16B is a functional plan view similar to FIG. 16A but showing how an FSB array positioned upstream of the sand bar depletes the high stream current energy and thereby prevents sand bar drifting.

As also mentioned previously, the use of the FSB array 20A can prevent underwater sand bar drifting. In particular, as shown in FIG. 16A, underwater sand bars have a tendency to drift over time due to the high energy of the stream current. This poses a danger to shipping and boaters since a drifting sand bar needs to be identified as it changes position. However, by positioning an FSB array 20A upstream of the sand bar, the heavy stream current energy is depleted by the FSB array 20 and the sand bar remains in place.

References

Blevins, R. D., (1990), Flow-Induced Vibrations, Van Nostrand Reinhold, New York.

Bernitsas, M. M., K. Raghavan, Y. Ben-Simon and E. M. H. Garcia (2006), "VIVACE (Vortex Induced Vibration for Aquatic Clean Energy): A New Concept in Generation of Clean and Renewable Energy from Fluid Flow", Proceedings of OMAE2006, Paper OMAE06-92645, Hamburg, Germany Jun. 4-9, 2006.

Cépron, D, B. Gaurier and G. Germain (2008), "Vortex-Induced Vibrations and Wake Induced Oscillations Using Wake Oscillator Model: Comparison on 2D Response with Experiments," Pre-Print, $9_{th}$ International Conference on Flow-Induced Vibrations, Prague, June.

Farshidianfar, A. and H. Zanganeh (2009), "The Lock-in Phenomenon in VIV using a Modified Wake Oscillator Model for both High and Low Mass-Damping Ratio", Iranian Journal of Mechanical Engineering, Vol. 10, No. 2, September, pp. 5-28.

Jauvitis, N. and C. H. K. Williamson (2004), "The Effects of Two Degrees of Freedom on Vortex-Induced Vibration at Low Mass and Damping", J. Fluid Mechanics, Vol. 509, pp. 23-62.

Leong, C. M. and T. Wei (2008), "Two-Degree-of-Freedom Vortex-Induced Vibrations of a Pivoted Cylinder Blow Critical Mass Ratio", Proceedings, Royal Society A, Vol. 464, pp. 2907-2927.

Ng, L., R. H. Rand, T. Wei and W. L. Keith (2001), "An Examination of Wake Oscillator Models for Vortex-Induced Vibrations", Naval Undersea Warfare Center Division, Newport, R.I., Tech. Rep. 11, 298, 1 Aug. 2001.

McCormick, M. E. and D. Folsom (1973), "Planing Characteristics of Fast-Water Buoys", J. Waterways and Harbor (ASCE), Vol. 99, No. WW4, November.

McCormick, M. E. and R. C. Murtha (2012), "Prototype Study of a Passive Wave-Energy Attenuating Bi-Modal Buoy", Murtech, Inc. Report 12-1, January.

McCormick, M. E. and J. Steinmetz (2011), "Full-Scale Experimental Study of Bi-Modal Buoy", U. S. Naval Academy, Report EW 01-11, June.

Miles, J. W. (1952), "On the Interference Factors for Finned Bodies", J. Aeronautical Sciences, Vol. 19, No. 4, April, p. 287.

Ogink, R. H. M and A. V. Metrikine (2010), "A Wake Oscillator with frequency Dependent Coupling for the Modeling of Vortex-Induced Vibration", J. Sound and Vibration (Elsevier), No. 329, pp. 5452-5473.

Ryan, K., M. C. Thompson, K. Hourigan (2002), "Energy Transfer in a Vortex Induced Vibrating Tethered Cylinder System", Preprint, Proceedings, Conf. on Bluff Bodies and Vortex Shedding, Port Douglas, Australia, December.

Rodenbusch, G. (1978), "Response of a Pendulum Spar to 2-Dimensional Random Waves and a Uniform Current", MIT-Woods Hole Ocean Engineering Program, Ph.D. Dissertation, 1978.

Shiguemoto, D. A., E. L. F. Fortaleza and C. K. Morooka, (2010), "Vortex Induced Motions of Subsurface Buoy with a Vertical Riser: A Comparison between Two Phenomenological Models" Pre-Print, Proceedings, 23° Congresso Nacional de Transporte Aquaviário, Construção Naval e Offshore Rio de Janeiro, October.

Sobey, R. J. and G. M. Mitchell (1977), "Hydrodynamic of Circular Piles", Proceedings, $6_{th}$ Australian Hydraulics and Fluid Mechanics Conference, Adelaide, December, pp. 253-256.

It should be noted that in addition to the viscous wake drag, the wave drag on the FSB structure is included in determining the performance. Analysis of the FSB 20 deployed in six feet of water was performed where current speed varies from 3 fps to 10 fps. The results show that cross-current width, from the bed to the free-surface, is between 1.8 and 1.9 of the fin diameter (D). That is, over this width, the power of the current is totally absorbed by the wake and motions of the FSB 20. As a result, the FSB 20 can be an effective "green" tool in current control.

It should be pointed out at this juncture that the exemplary embodiments shown and described above constitute a few examples of a large multitude of buoys that can be constructed in accordance with this invention. Thus, the FSB 20 of this invention can be of different sizes and shapes and can have any number of horizontal and/or vertical oriented fins. The particular, size, shape, construction and spacing of the buoys are a function of the particular application to which the FSBs 20 are used. There are two parameters that appear to be paramount in the development of any particular system for any particular application. Those are the added-mass and the time-dependent viscous drag coefficient. The parameters depend on the shape of the buoy part of the system, in addition to the frequency and amplitudes of the two motions. Moreover, since the design of each buoy unit of any system is based on a specific current-water depth relationship, the individual buoy units of an array will be separated according to the capture width for that relationship.

Without further elaboration, the foregoing will fully illustrate the invention that others might, by applying current or future knowledge, adopt the same for use under various conditions of service.

What is claimed is:

1. A method for reducing the energy in a stream or river current, said method comprising:

locating a plurality of buoys upstream of an object that is at least partially submerged and exposed to the stream or river current, each of said buoys comprising:

an elongated cylindrical body with a plurality of vertically-oriented fins protruding radially away from an outer surface of said body; and each of said bodies comprises a center staff;

anchoring said plurality of buoys, via their respective staffs, to a bed in the stream or river; and permitting said plurality of buoys to pivot about said anchor due to exposure of said plurality of buoys within the stream or river that causes buoy movement and vortex shedding, thereby dissipating energy of the stream or river current.

2. The method of claim 1 wherein said step of locating a plurality of buoys comprises positioning said plurality of buoys transversely of a flow of the stream or river current.

3. The method of claim 1 wherein said object comprises at least one piling that is secured to a bed in the stream or river current.

4. The method of claim 1 wherein said object comprises a submerged sand bar.

5. The method of claim 4 wherein each of said center staffs is coupled to a hinge and wherein said step of anchoring said plurality of buoys comprises anchoring each of said hinges to the stream or river bed, said hinge permitting said body to freely rotate about said hinge.

6. The method of claim 5 wherein each of said bodies further comprises a horizontal plate located at a base of said body, said horizontal plate limiting any axial motion of said body along a body axis when said body is exposed to the stream or river.

7. The method of claim 6 wherein further comprising the step of each of said bodies adjusting to changes in a mean water level in the stream or river.

8. The method of claim 1 further comprising the step of determining the performance of each of said plurality of buoys when exposed within the stream or river, said method comprising determining a capture width of each of said plurality of buoys, said capture width defining an effective width of said buoy that results in said dissipation of the energy of the stream or river current.

9. The method of claim 8 wherein said capture width comprises a wave-making and wave drag component and a vortex-induced vibration component.

10. The method of claim 9 wherein said step of determining a capture width of each of said plurality of buoys comprises:

(a) determining total damping coefficients of said buoy from still-water motions of said buoy from an initial angular displacement;

(b) using said total damping coefficients to determine linear-equivalent damping coefficients of said buoy based upon a predetermined angular velocity of said buoy averaged over a period of rotation;

(c) determining inertial coefficients of said buoy with respect to said pivoting about said anchor, said pivoting about said anchor using a spring-loaded hinge;

(d) determining critical damping of said buoy and a natural circular frequency of said buoy using said inertial coefficients, a hydrostatic restoring moment coefficient of said buoy and a rotational spring constant of said spring;

(e) determining phase angles between an excitation moment of said buoy and said buoy motions using said critical damping of said buoy;

(f) determining a vortex shed frequency using a Strouhal number which is a function of a Reynolds number for said buoy;

(g) determining excitation moments of said buoy based on a lift coefficient and a drag coefficient of said buoy; and (h) determining in-line and transverse responses of said buoy as a function of time to define said wave-making and wave drag component and said vortex-induced vibration component and then calculating said capture width by summing said wave-making and wave drag component with said vortex-induced vibration component.

11. A buoy array for reducing the energy in a stream or river current, said buoy array comprising:

a plurality of buoys that are disposed at a predetermined distance from one another upstream of an object that is at least partially submerged and exposed to the stream or river current, said plurality of buoys being positioned transversely of said stream or river current, each one of said plurality of buoys comprising:

an elongated cylindrical body with a plurality of vertically-oriented fins protruding radially away from an outer surface of said body; and wherein each of said bodies comprises a center staff that is pivotally-coupled to an anchor embedded in a stream or river bed, each of said bodies being freely rotatable about said anchor when each of said bodies are exposed within the stream or river that causes buoy movement and vortex shedding, thereby dissipating energy of the stream or river current.

12. The buoy array of claim 11 wherein each center staff is pivotally coupled to a respective anchor via a respective hinge, each of said hinges permitting said body to freely rotate about said hinge when each of said bodies are exposed within the stream or river that causes buoy movement and vortex shedding, thereby dissipating energy of the stream or river current.

13. The buoy array of claim 12 wherein each of said hinges is a spring-loaded hinge.

14. The buoy array of claim 11 wherein each of said bodies further comprises a horizontal plate located at a base of said body, said horizontal plate limiting any axial motion of said body along a body axis when said body is exposed to the stream or river, said horizontal plate adjusting to changes in a mean water level in the stream or river.

15. The buoy array of claim 11 wherein each buoy comprises a capture width that determines the performance of each of said buoys in dissipating the energy of the stream or river.

16. The buoy array of claim 15 wherein said capture width comprises a wave-making and wave-drag component and a vortex-induced vibration component.

17. The buoy array of claim 16 wherein said capture width of each of said buoys is determined by determining in-line and transverse responses of each of said buoys as a function of time to define said wave-making and wave-drag component and said vortex-induced vibration component, respectively, and then calculating said capture width by summing said wave-making and wave-drag component with said vortex-induced vibration component.

18. The buoy array of claim 11 wherein said object comprises at least one piling that is secured to a bed in the stream or river current.

19. The buoy array of claim 11 wherein said object comprises a submerged sand bar.

* * * * *